US008256935B1

(12) United States Patent
Cullimore et al.

(10) Patent No.: US 8,256,935 B1
(45) Date of Patent: Sep. 4, 2012

(54) SIMULATED ELECTRONIC FLAME APPARATUS AND METHOD

(76) Inventors: Jay N. Cullimore, Oakland, MI (US); Susan Kovarik, Davie, FL (US)

( * ) Notice: Subject to any disclaimer, the term of this patent is extended or adjusted under 35 U.S.C. 154(b) by 186 days.

(21) Appl. No.: 12/534,207

(22) Filed: Aug. 3, 2009

(51) Int. Cl.
*F21V 35/00* (2006.01)
*F21L 19/00* (2006.01)

(52) U.S. Cl. ..... 362/392; 362/276; 362/802

(58) Field of Classification Search ..... 362/569, 362/396, 276, 810, 392
See application file for complete search history.

(56) References Cited

U.S. PATENT DOCUMENTS

| | | | | |
|---|---|---|---|---|
| 5,034,658 | A * | 7/1991 | Hierig et al. | 315/76 |
| 5,936,521 | A * | 8/1999 | Blackman | 340/540 |
| 6,053,622 | A * | 4/2000 | Horowitz et al. | 362/276 |
| 6,217,199 | B1 * | 4/2001 | Lo et al. | 362/414 |
| 7,261,455 | B2 * | 8/2007 | Schnuckle et al. | 362/569 |
| 7,503,668 | B2 * | 3/2009 | Porchia et al. | 362/161 |
| 7,677,753 | B1 * | 3/2010 | Wills | 362/161 |
| 7,686,471 | B2 * | 3/2010 | Reichow | 362/161 |
| 7,744,254 | B2 * | 6/2010 | Spiro | 362/297 |
| 7,828,462 | B2 * | 11/2010 | Jensen et al. | 362/249.02 |
| 2005/0225984 | A1 * | 10/2005 | Theobald | 362/276 |
| 2006/0146544 | A1 * | 7/2006 | Leung | 362/392 |

* cited by examiner

*Primary Examiner* — Stephen F. Husar
*Assistant Examiner* — Peggy A. Neils
(74) *Attorney, Agent, or Firm* — Lorusso & Associates

(57) ABSTRACT

An apparatus and method for creating electronically simulated flames is disclosed. The apparatus includes features to allow for remote control of multiple electronic flame apparatuses with hand held transmitters and/or computer control with the use of a transceiver. The apparatus can employ incandescent and LED type bulbs or lamps to create a variety of color and brightness conditions. An Internet-based portal is also disclosed to allow for remote access by authorized users.

20 Claims, 28 Drawing Sheets

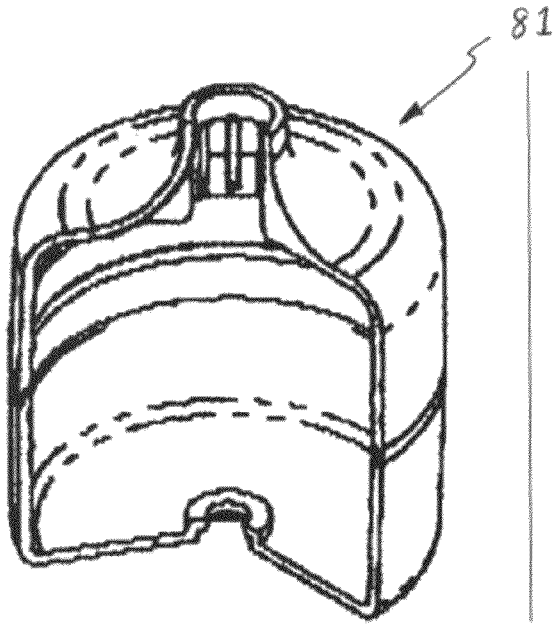
Top & bottom halves assembled
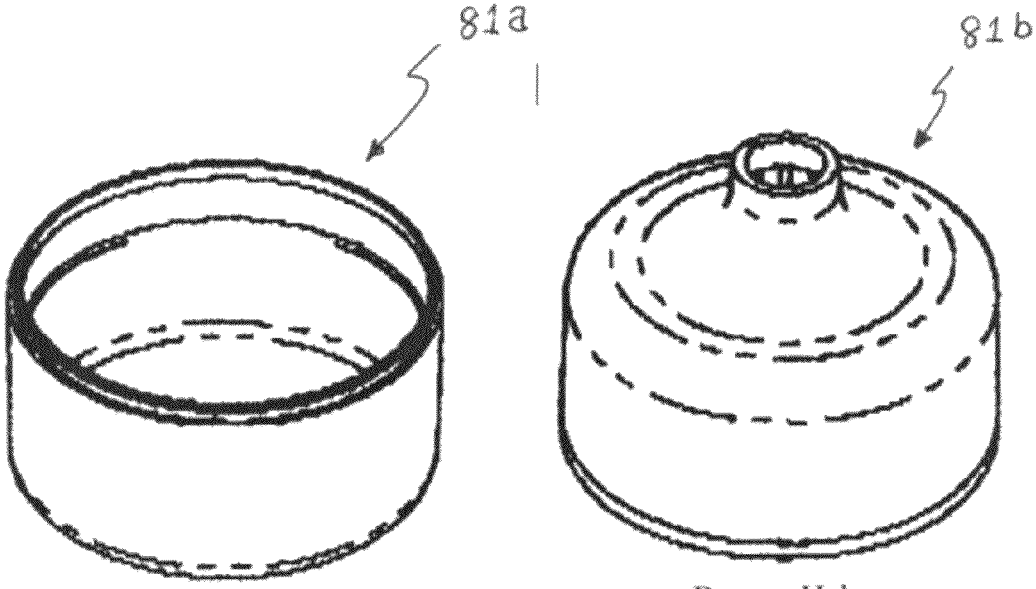
Top Halve
Bottom Halve
FIG 5

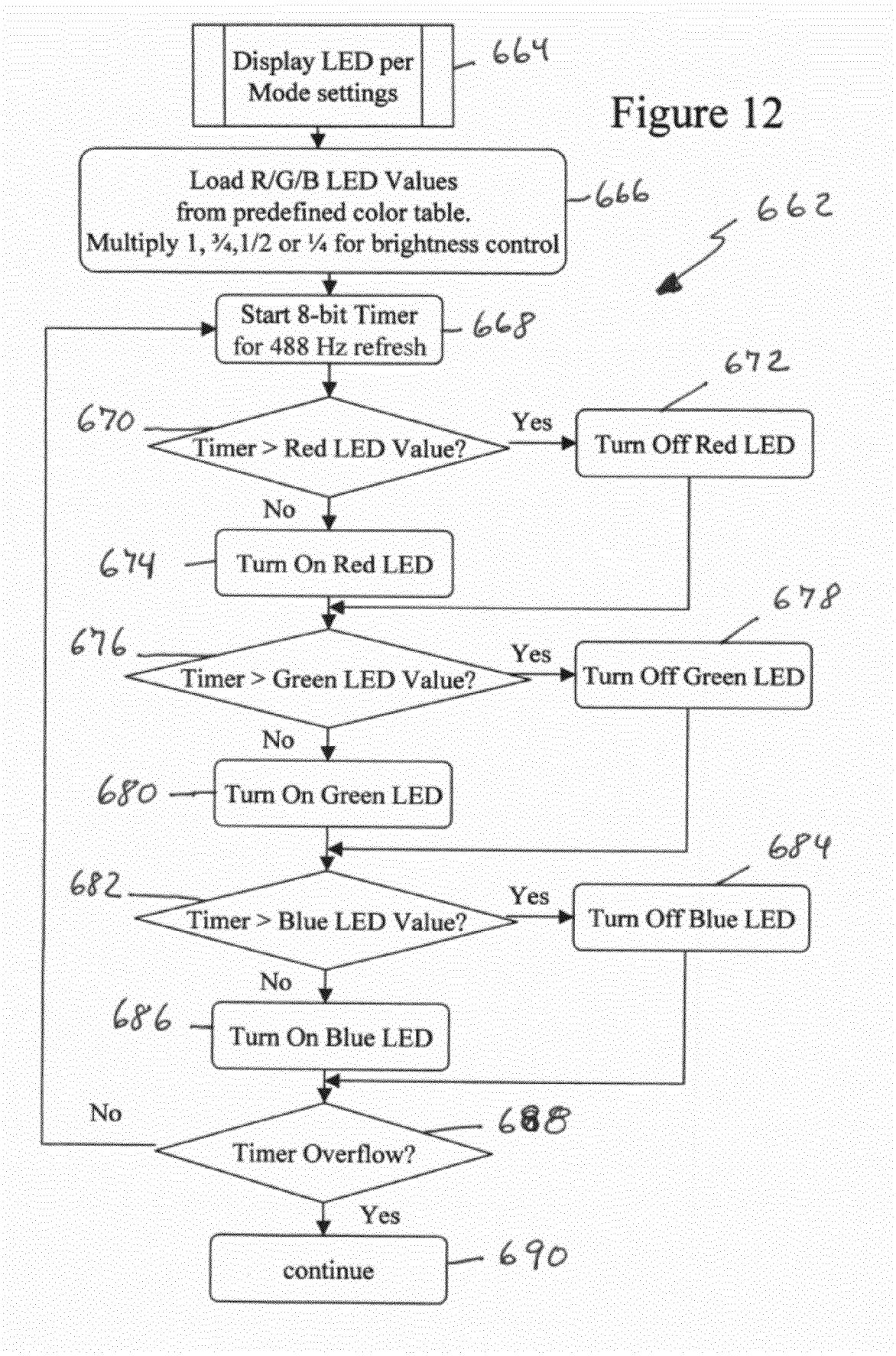
Display LED per Mode settings
664
Figure 12
Load R/G/B LED Values from predefined color table. Multiply 1, ¾,1/2 or ¼ for brightness control
666
662
Start 8-bit Timer for 488 Hz refresh
668
672
670
Timer > Red LED Value?
Yes
Turn Off Red LED
No
674
Turn On Red LED
678
676
Timer > Green LED Value?
Yes
Turn Off Green LED
No
680
Turn On Green LED
684
682
Timer > Blue LED Value?
Yes
Turn Off Blue LED
No
686
Turn On Blue LED
No
688
Timer Overflow?
Yes
690
continue

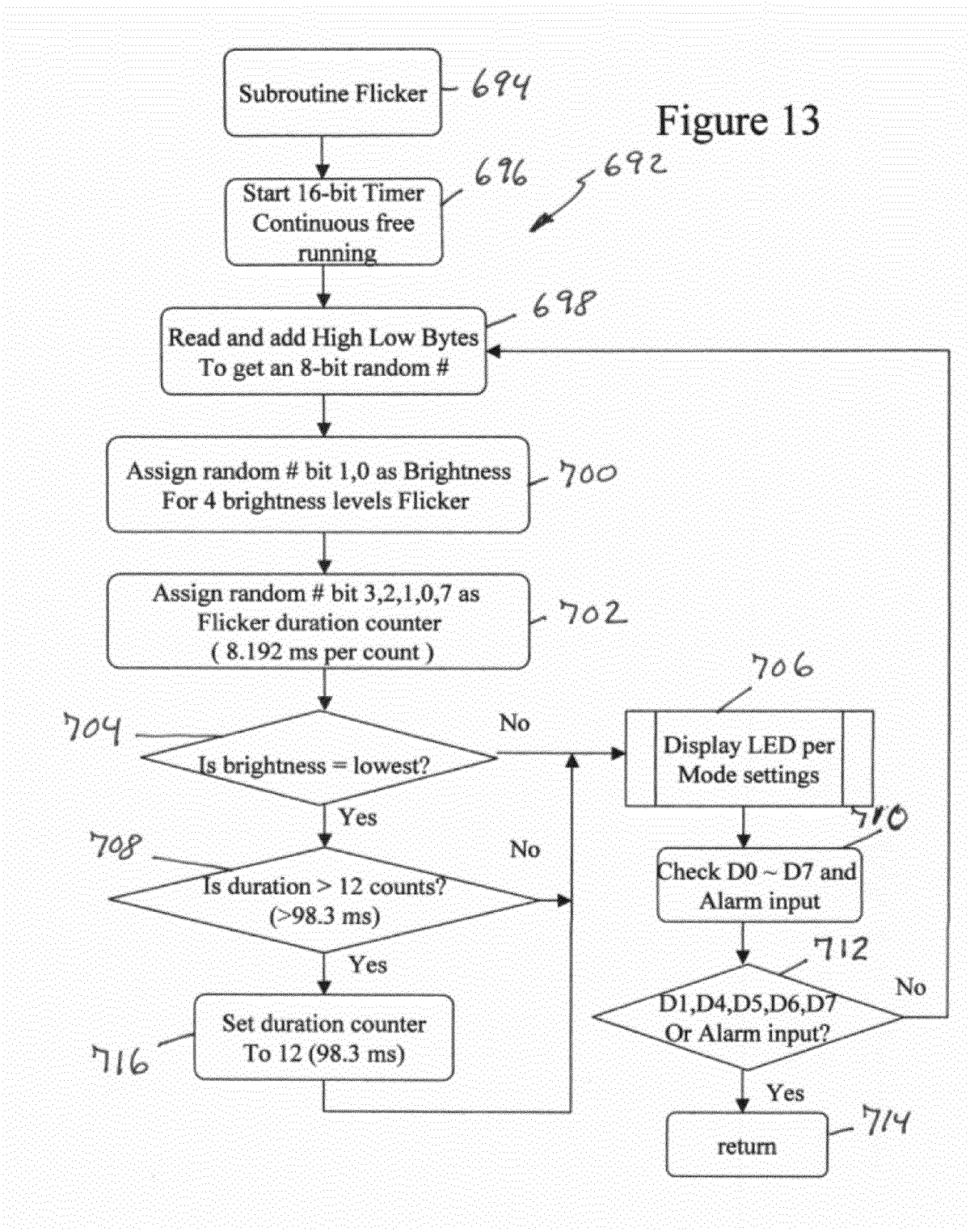
Subroutine Flicker
694
Figure 13
692
Start 16-bit Timer Continuous free running
696
Read and add High Low Bytes To get an 8-bit random #
698
Assign random # bit 1,0 as Brightness For 4 brightness levels Flicker
700
Assign random # bit 3,2,1,0,7 as Flicker duration counter ( 8.192 ms per count )
702
704
Is brightness = lowest?
No
Yes
706
Display LED per Mode settings
708
Is duration > 12 counts? (>98.3 ms)
No
Yes
710
Check D0 ~ D7 and Alarm input
712
D1,D4,D5,D6,D7 Or Alarm input?
No
Yes
Set duration counter To 12 (98.3 ms)
716
return
714

762
Subroutine Color Select
764
Disable Timer to Stop Wash
766
Was in Wash Mode Just before D5 input?
768
Yes
Return ( Freeze in-between Color )
770
No
Increment current Color Counter by 1
772
Is Color Counter > 10?
774
Yes
Set Color Counter To 1 ( Amber )
776
No
Return
778

780
Subroutine Memory 1
782
Is D6 key pressed more Than 3 seconds?
784
Yes
Save all modes parameters and variables into EEPROM Memory 1 location
786
No
Restore all modes parameters and variables from EEPROM Memory 1 location
788
Blink LED 2 times
790
Return
792

Subroutine Memory 2
796

794
800
798
Is D7 key pressed more Than 3 seconds?
Yes
Save all modes parameters and variables into EEPROM Memory 2 location
No
802
804
Restore all modes parameters and variables from EEPROM Memory 2 location
Blink LED 2 times
Return
806

Subroutine Auto On/Off Timer
797

795
799
Is D7 key pressed more Than 3 seconds?
Yes
801
Save all modes parameters and variables into EEPROM On/Off Timer location
No
803
Restore all modes parameters and variables from EEPROM On/Off Timer location
805
Blink LED 2 times
Return
807

Timer Interrupt
824

822
Calculate difference between current and next Color R/G/B LED values
826
828
Has time lapsed 1.4 seconds? ( 3 minutes divided by 128 steps )
Yes
830
Increment or decrement R/G/B Value 1 step to next Color
No
Return from Interrupt
834
Return from Interrupt
832

856
Subroutine Alarm
858
Is the system Armed?
( Arm Flag = 1?)
860
No
Yes
Is the Magnet present?
862
No
Yes
Arm the system
( Arm Flag = 1 )
864
Disarm the system
( Arm Flag = 0 )
866
Is the Magnet present?
870
Yes
No
Triggered Silent Alarm
( Red LED Blinks )
872
Return
868
Is the Magnet present?
874
Yes
No
Has 10 minutes lapsed?
876
Yes
No
Stop Red LED Blinking
878
Return
880
D3 Key received?
882
Yes
No Fluorescent Material Backlighted Menu or Sign Example

SIMULATED ELECTRONIC FLAME APPARATUS AND METHOD

BACKGROUND OF THE INVENTION

The present disclosure relates to a method and apparatus for remotely controlling lighting systems. More specifically, the present disclosure relates to a method and apparatus for remotely controlling lighting systems with radio frequency, infrared, line carrier technologies and direct data signals.

DESCRIPTION OF THE ART

Incandescence bulb candles have been in use for over 20 years with very little change in their function and design over that period. Some of these designs involve replaceable one-time use or rechargeable batteries. The rechargeable type candles are typically placed into a recharging device that may accept one unit by having a single recharging adaptor for each candle or the charger device may handle multiple candle units at a time. The candle will turn on when removed from the charger unit, or when turned on with a mechanical switch. These candles typically have an illumination time of 6-8 hours before needing to be recharged for a period of about 8 hours. What is needed and what is disclosed herein is an apparatus and method for remotely controlling and configuring electronically simulated flames for use in commercial and residential settings.

SUMMARY OF THE INVENTION

In one aspect of the present disclosure, a simulated electronic flame apparatus is disclosed in which the apparatus is remotely controlled using IR and other communication media to control the, duration, brightness, color and intensity characteristics of an electronically produced light, or illumination source, to mimic the characteristics of natural flame. The apparatus can be controlled remotely by a hand held transmitter or by a computer-based control system.

In another aspect of the disclosure, piezo sensors are used to detect and monitor ambient air currents contacting the flame apparatus so as to adjust the lighting elements to mimic the effects of air currents on exposed natural flames. The sensors are arranged in the apparatus so as to monitor air movement in multiple directions.

In a further aspect of the disclosure, touch screen displays are provided to set candle lighting profiles that accommodate a wide variety of settings such as brightness, flickering and duration. Profiles are configured and saved in a database for ease of retrieval and use.

In a yet further aspect of the disclosure, an Internet-based portal is used to remotely access electronic candle apparatuses. The portal is configured to require pass codes to allow access to the system. Access to multiple accounts is given to system distributors and service specialists. These and other aspects of the disclosure will become apparent from a review of the appended drawings and the detailed description.

BRIEF DESCRIPTION OF THE DRAWINGS

FIG. 5 are multiple perspective and partial sectional views of an electronic candle holder base and subsections according to one embodiment of the disclosure.

FIG. 12 is an RGB LED electronic candle color setting block diagram according to one embodiment of the disclosure.

FIG. 13 is an electronic candle brightness and flicker setting block diagram according to one embodiment of the disclosure.

FIG. **20*a*** is an electronic candle on/off timer subroutine block diagram according to a further embodiment of the invention.

Figure 21:
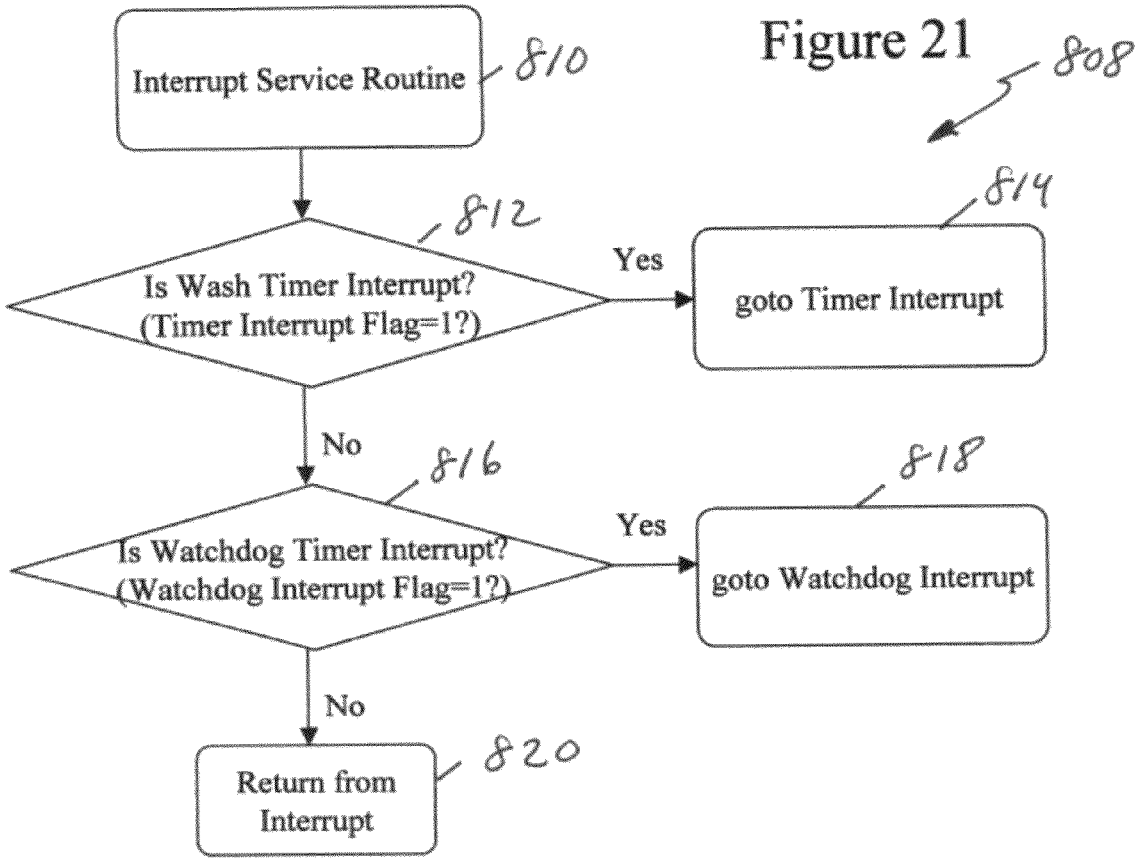

FIG. 21 is an electronic candle interrupt service subroutine block diagram according to an embodiment of the disclosure.

Figure 22:
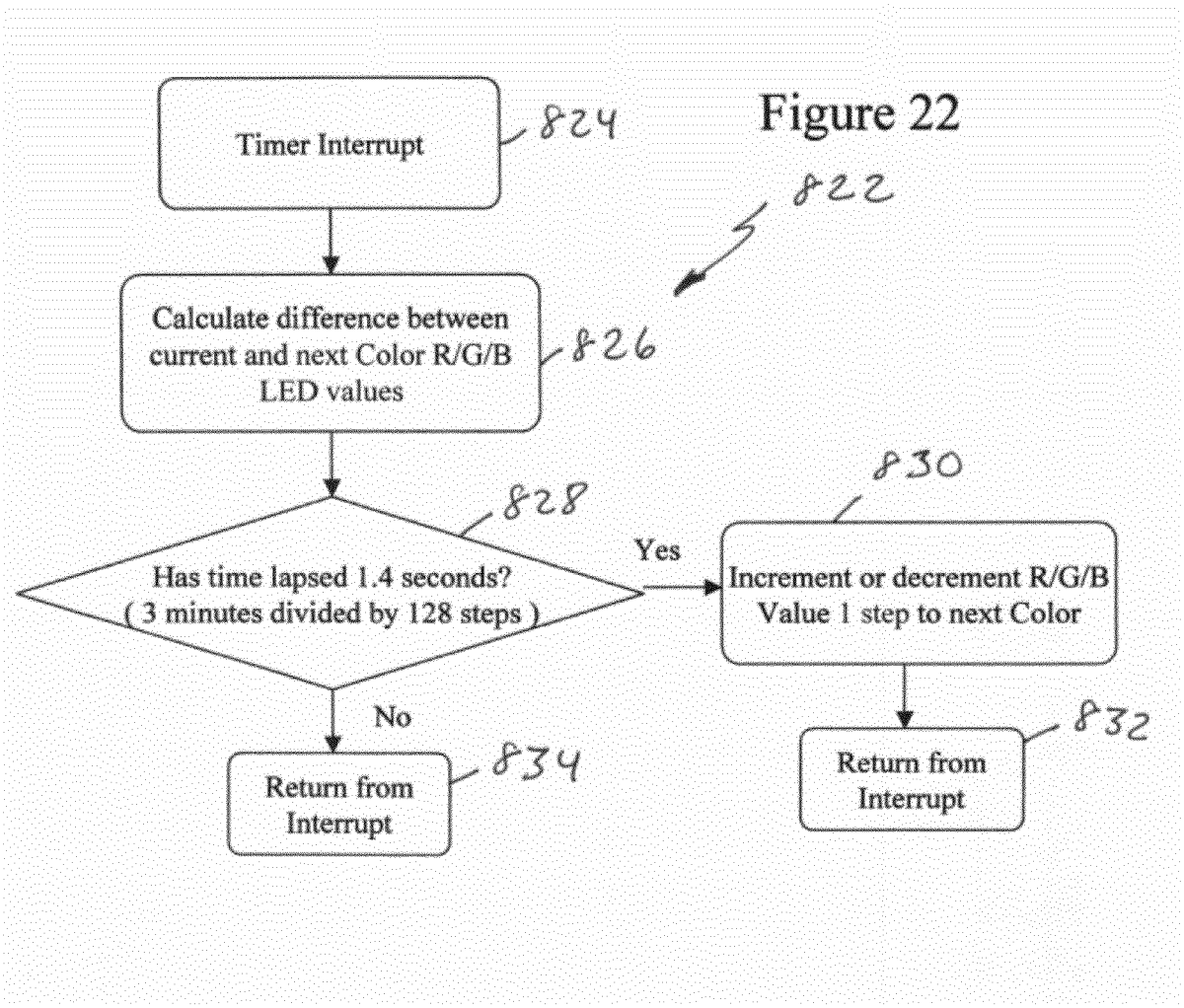

FIG. 22 is an electronic candle timer interrupt subroutine block diagram according to one embodiment of the disclosure.

Figure 23:
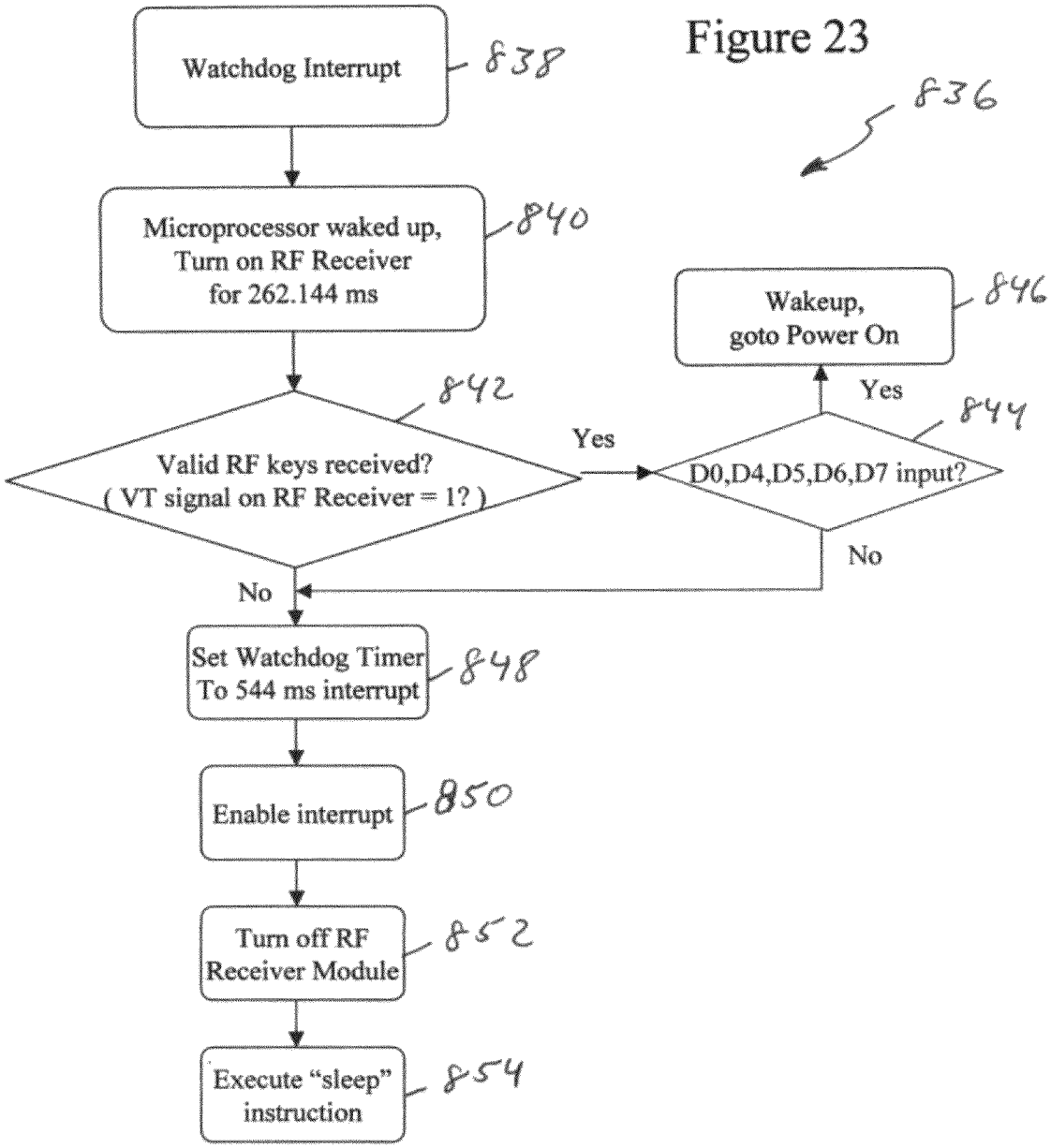

FIG. 23 is an electronic candle watchdog interrupt subroutine block diagram according to another embodiment of the disclosure.

Figure 24:
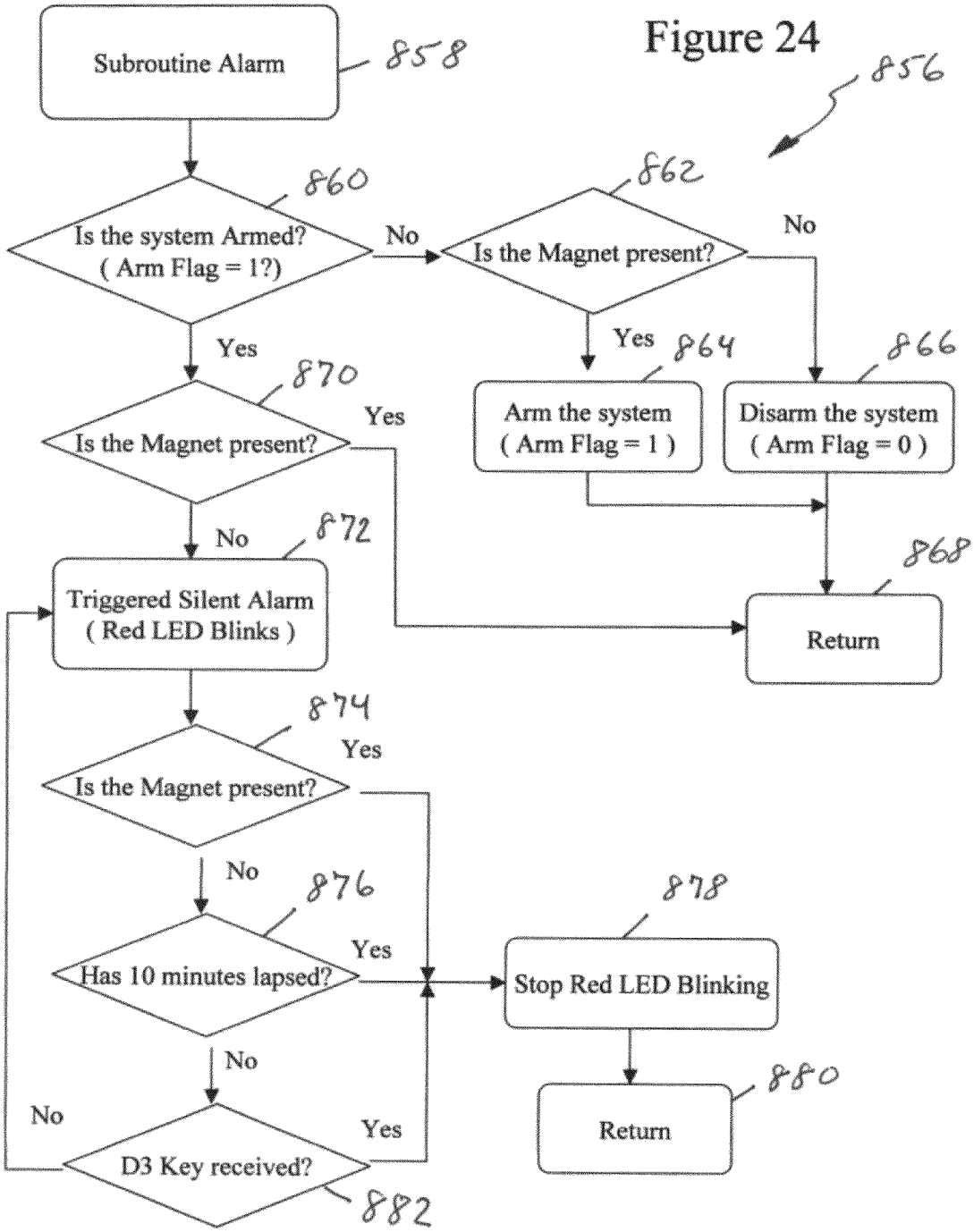

FIG. 24 is an electronic candle alarm subroutine block diagram according to one embodiment of the disclosure.

Figure 25:
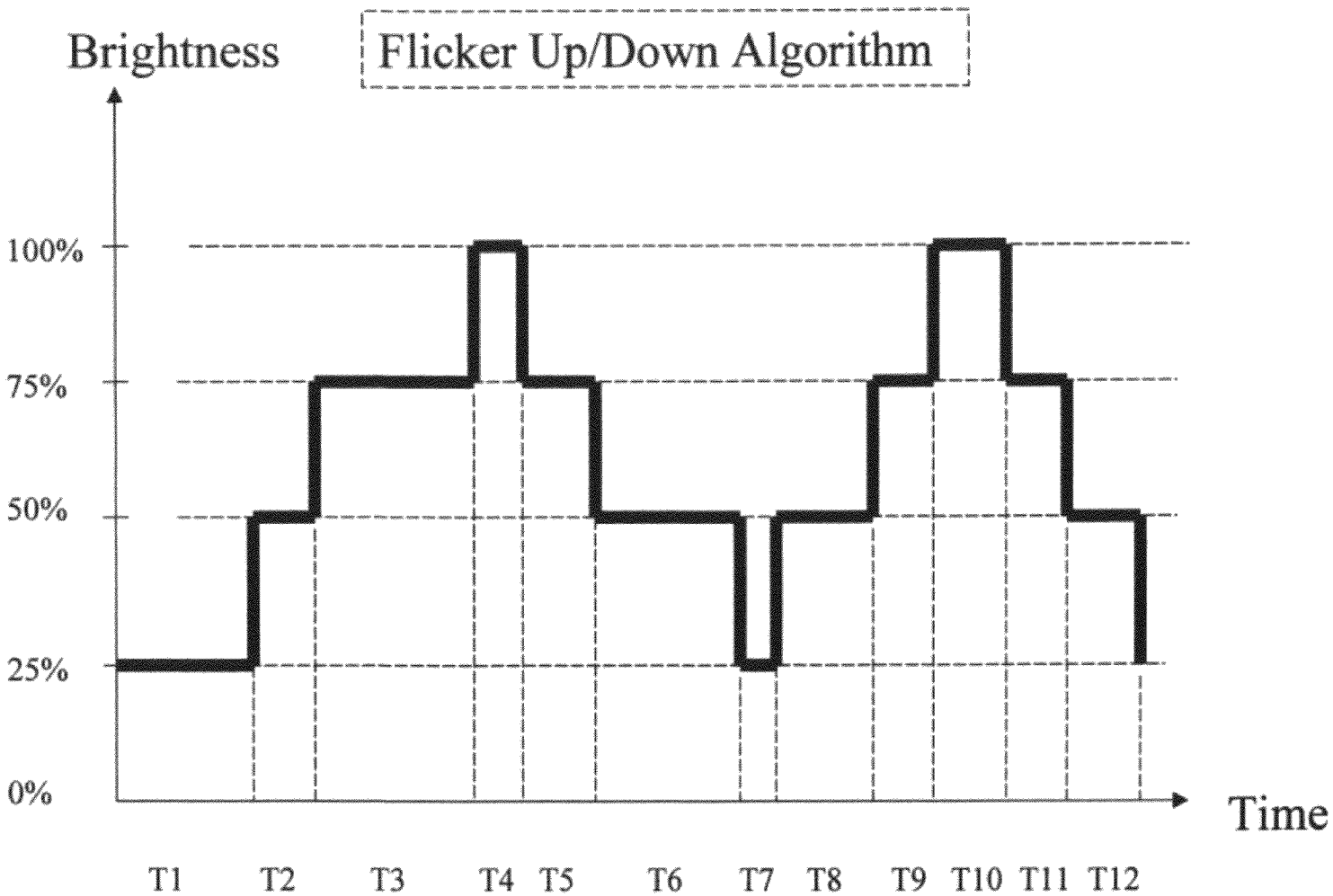

FIG. 25 is a light brightness flicker graph showing a flicker up/down algorithm according to another embodiment of the disclosure.

Figure 26:
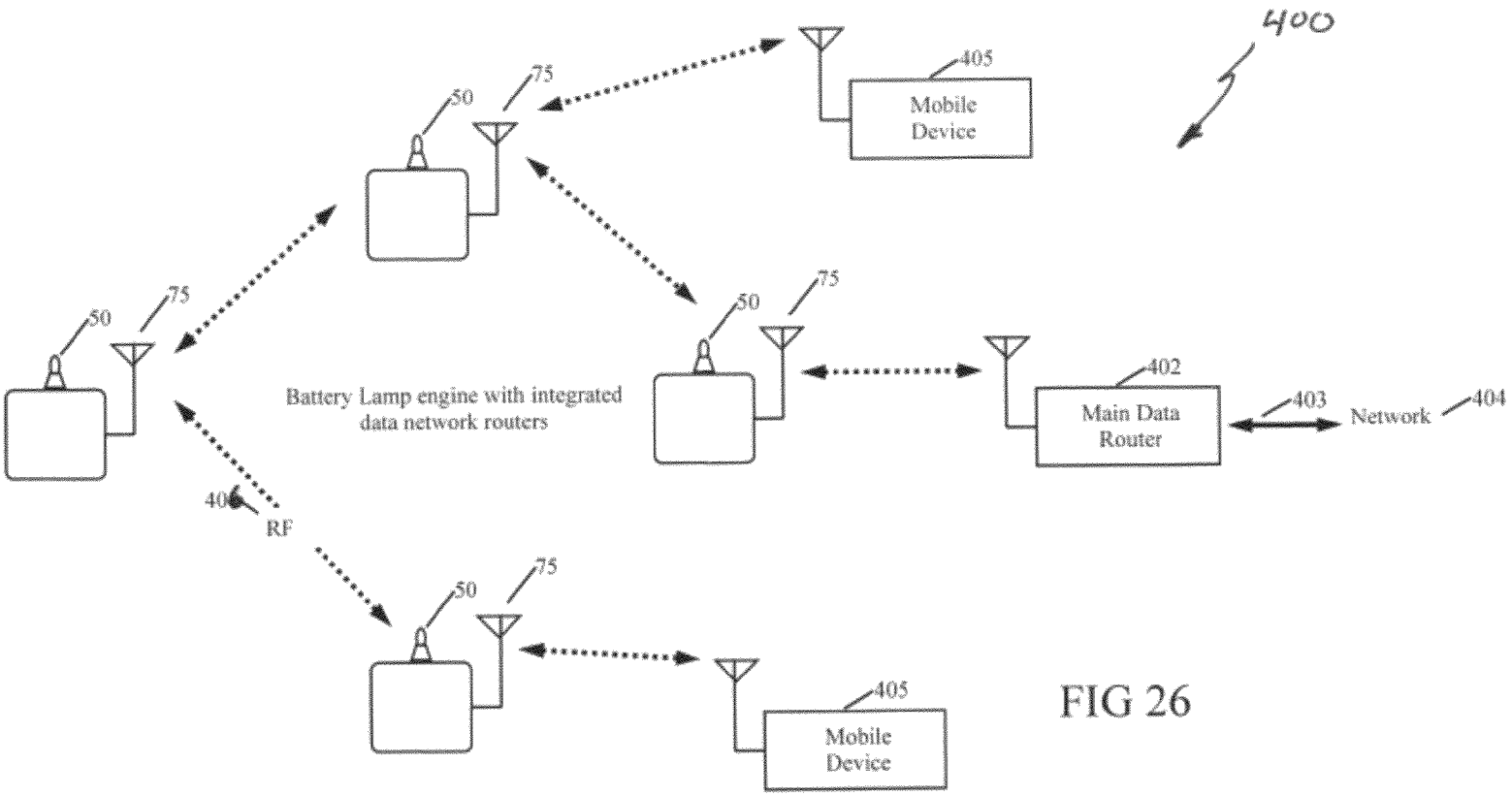

FIG. 26 is a flow diagram showing a remote controlled lighting system with a plurality of integrated lamp/data transport router assemblies in a network environment according to another embodiment of the disclosure.

Figure 27:
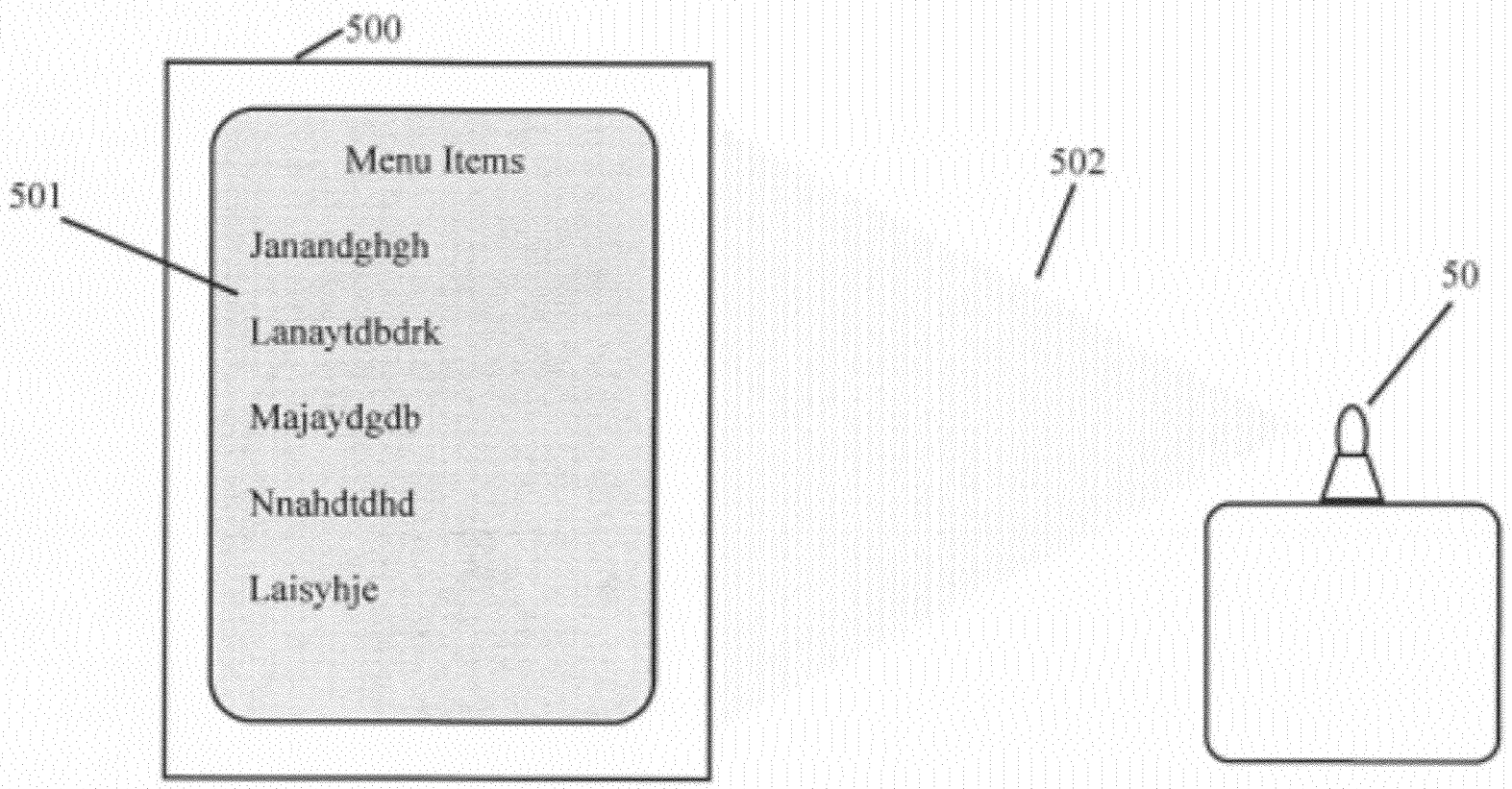

FIG. 27 shows a side elevational view of an electronic candle backlighting a fluorescent screen with highlighted menu according to a further embodiment of the disclosure.

DETAILED DESCRIPTION OF THE INVENTION

Figure 1:
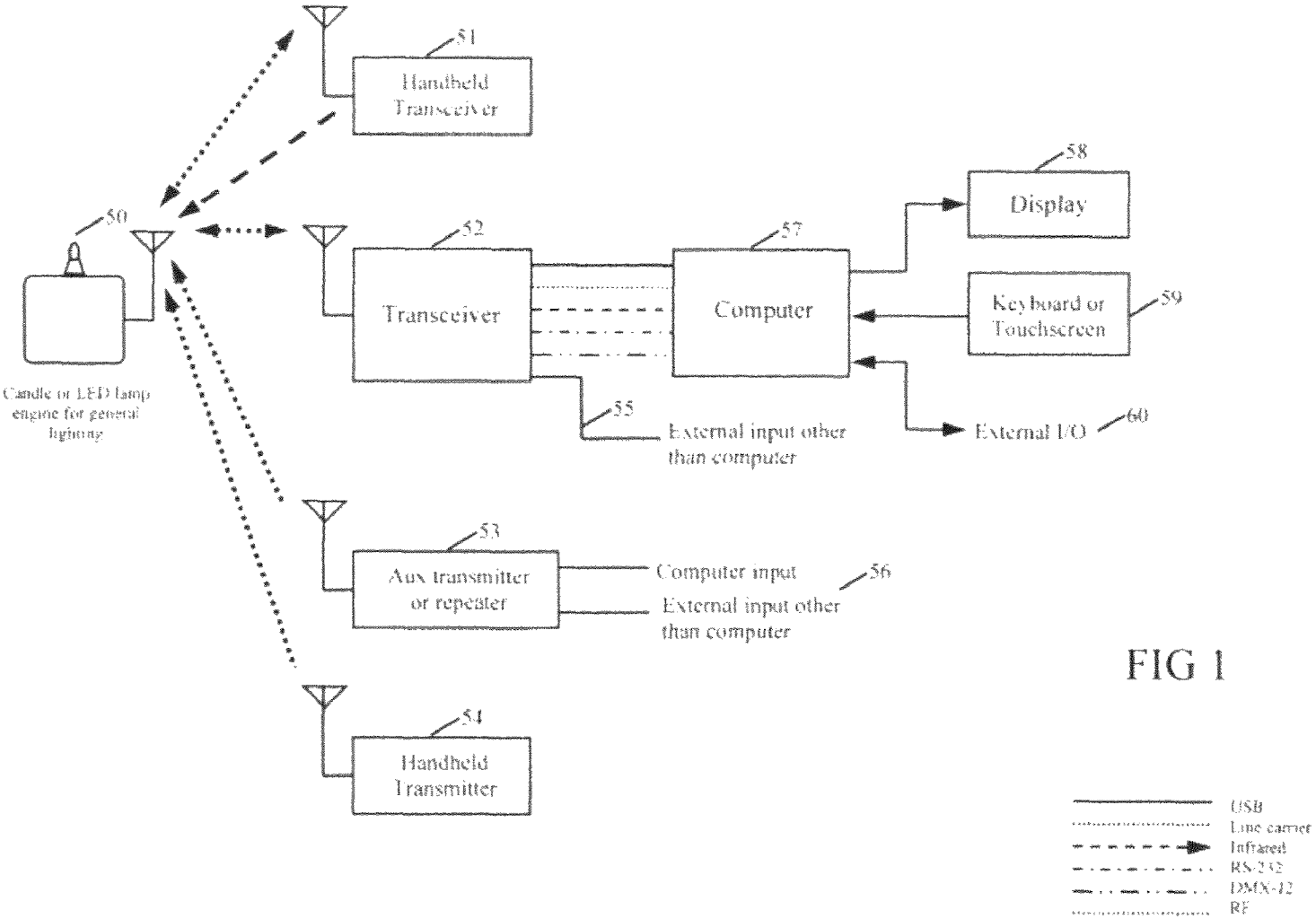
FIG. 1 is a flow diagram showing a remotely controlled lighting system according to one embodiment of the present disclosure.

Referring to the drawings and, in particular, FIG. 1, in one aspect of the present disclosure, an electronic candle or lamp control 50 provides controlled illuminecense. The luminescence produced by lamp 50 may be constant in intensity, brightness, and color, or may vary as to each attribute depending upon control signals received. Lamp 50, (also referred to as an illumination source herein), may be energized by battery (DC) or AC power. The light can be incandescent, halogen, fluorescent, LED and/or any other light source known in the art.

Lamp 50 can be controlled by a variety of sources wirelessly. In one embodiment, a handheld transceiver 51, (also referred to as a remote control herein), transmits control signals to, and receives data signals from, lamp 50. Signals can be transferred via RF or infrared transmissions.

In another embodiment, a computer controlled transceiver 52 sends control signals and receives data signals from lamp 50 via RF transmission. A computer 57 controls transceiver 52 via USB connection, line carrier, infrared, RS-232, DMX-12 and/or RF transmission. Computer 57 includes a display 58, a keyboard or touchscreen 59 to allow a user to input lamp control signals, and may include an external input/output source 60. If placed in a "stand-alone" operation status, an external control 55 can be used to send control signals to lamp 50. External output 55 may be connected to transceiver 52 with a USB connection.

Computer 57 sends control signals to lamp 50 and receives data from lamp 50 such as light intensity, color, etc. that can be used to adjust the lighting. The data received can also include two-way voice signals. Computer 57 may also be used to interface with a portal interface for sequencing configurations and user onscreen controls.

When used, for example, in a restaurant setting, computer 57 can also control lighting and be used as a point of sale application. Other applications include lighting control systems or other automated controllers.

In a further embodiment, an auxiliary transmitter 53 is used to repeat an RF signal from longer distances of operation than the handheld or computer controlled transceivers. Auxiliary transmitter 53 can also be used as a stand-alone transmitter with external control inputs.

In a yet further embodiment, a handheld transmitter 54 can be used to transmit control signals to lamp 50. This embodiment is particularly useful for users that require immediate access to light control without the need for data retrieval and analysis.

Figure 2:
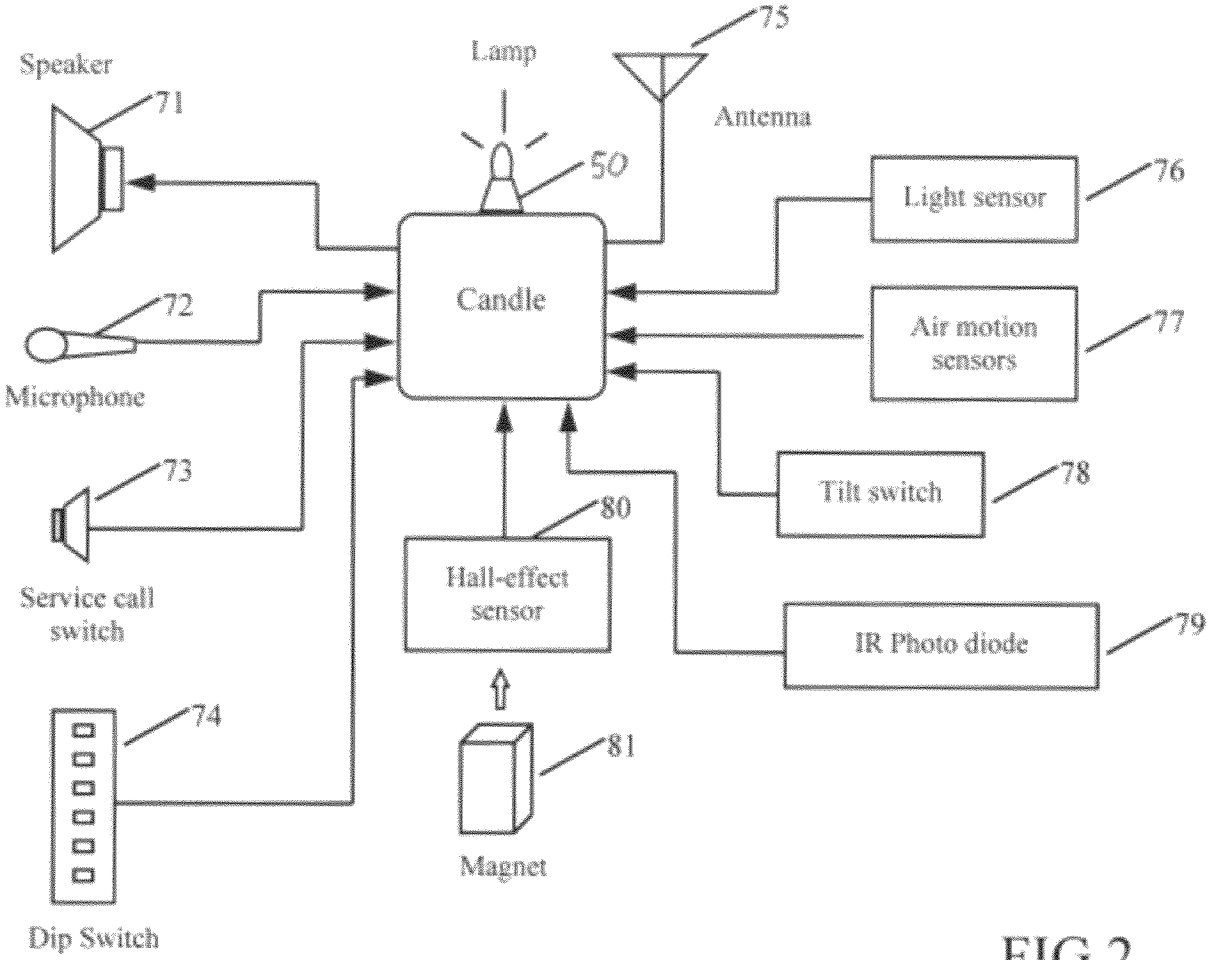
FIG. 2 is a diagram showing components of a remotely controlled lamp according to one embodiment of the disclosure.

Referring now to FIG. 2, lamp 50 may include an audio output speaker 71 to enable two-way voice communication. A microphone 72 may be internally mounted to pick up voice or other audible sounds for two-way voice communication. An input switch 73 (service call switch), may be incorporated into the body of lamp 50 to send messages via RF or other means to a central control station. An external access set DIP Switch 74 may be used to set the tri-state digital address of each individual lamp 50. DIP switch 74 may also include a switch to place lamp 50 in a sleep mode power "off condition."

DIP switch 74 may also include a switch to place lamp 50 in a "timer mode" that performs a 24-hour timer function that turns on lamp 50 the same time every day for a default hour-of-operation duration. The On/Off timer duration period can be adjusted in increments by toggling switch from Off to Timer then Off for each increment using a single dual throw (on/off timer) switch.

To provide a means to communicate with other components, lamp 50 may incorporate a dipole antenna 75 and/or an internal strip line. Antenna 75 is configured to receive and/or transmit RF signals.

To coordinate the luminosity of lamp 50 with ambient light, a light sensor 76 in the form of a photocell is incorporated to vary resistance with the amount of ambient light. Lamp 50 can be configured to activate in low ambient light conditions.

To monitor and adjust for air movement, piezo disc air movement sensors 77 are mounted externally on lamp 50 to provide air movement data along three axes. A tilt switch 78 detects tilt movement for control and alarm functions.

To receive and send infrared control and/or data signals, an infrared photo diode is incorporated into lamp 50 to receive control signals from handheld transmitter 54 as an alternate method of signal transmission.

A hall-effect sensor 80 is incorporated into lamp 50 to detect the presence of a magnetic lamp holder base to provide On/Off and color change functions. Lamp holder base 81 includes a magnet to activate hall-effect sensor 80. Holder base 81 includes a top half 81*a* and a bottom half 81*b* as shown in FIG. 5.

Figure 3:
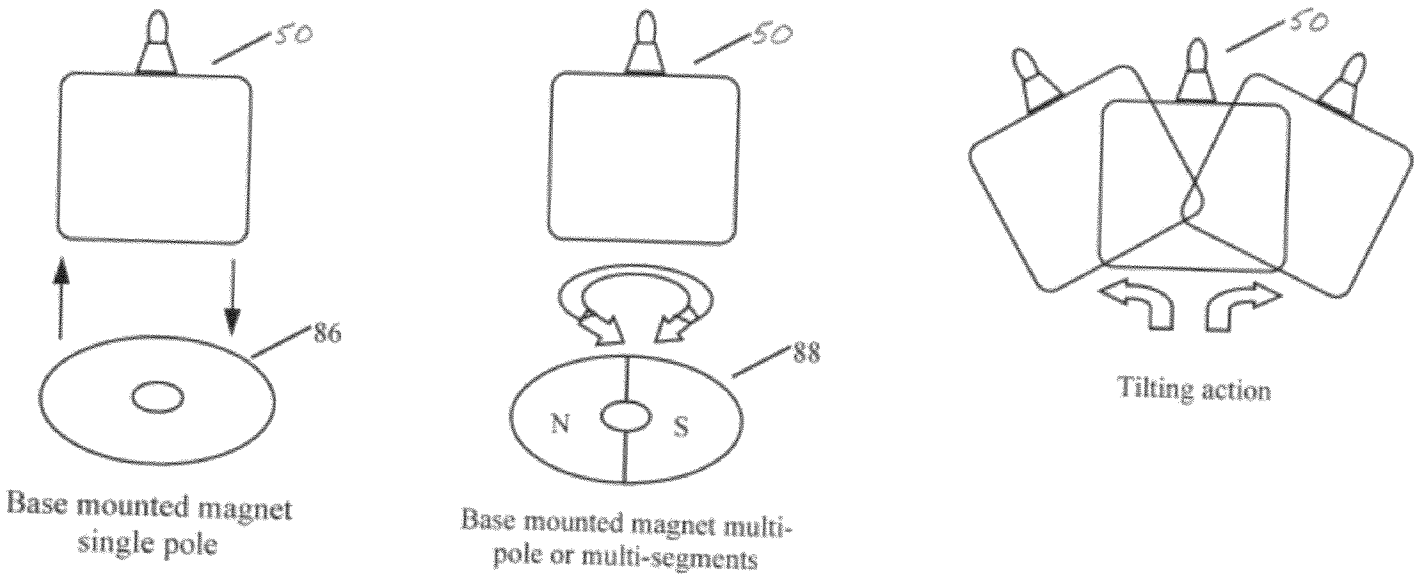
FIG. 3 shows magnet and tilt configurations for a remotely controlled lamp according to one embodiment of the disclosure.

Referring now to FIG. 3, magnet and lamp tilt configurations are shown. Vertical placement and removal of lamp 50 from lamp holder base 81 causes activation and deactivation, respectively, of alarm trigger, lamp illumination, and color schemes depending on the programming used. A single pole magnet 86 may be used to provide basic functionality. A multi-pole or multi-segment magnet 88 may be used having north and south pole segments placed in a circular pattern so as to allow multiple control actions, such as illumination and color scheme, by rotating lamp 50 about the base.

Mechanical disturbance of lamp 50 in the form of titling is sensed by tilt switch 78, which can activate certain functions including an alarm trigger if lamp 50 is displaced or titled. Tilt switch 78 may perform a single or multiple functions depending on the programming.

Figure 4:
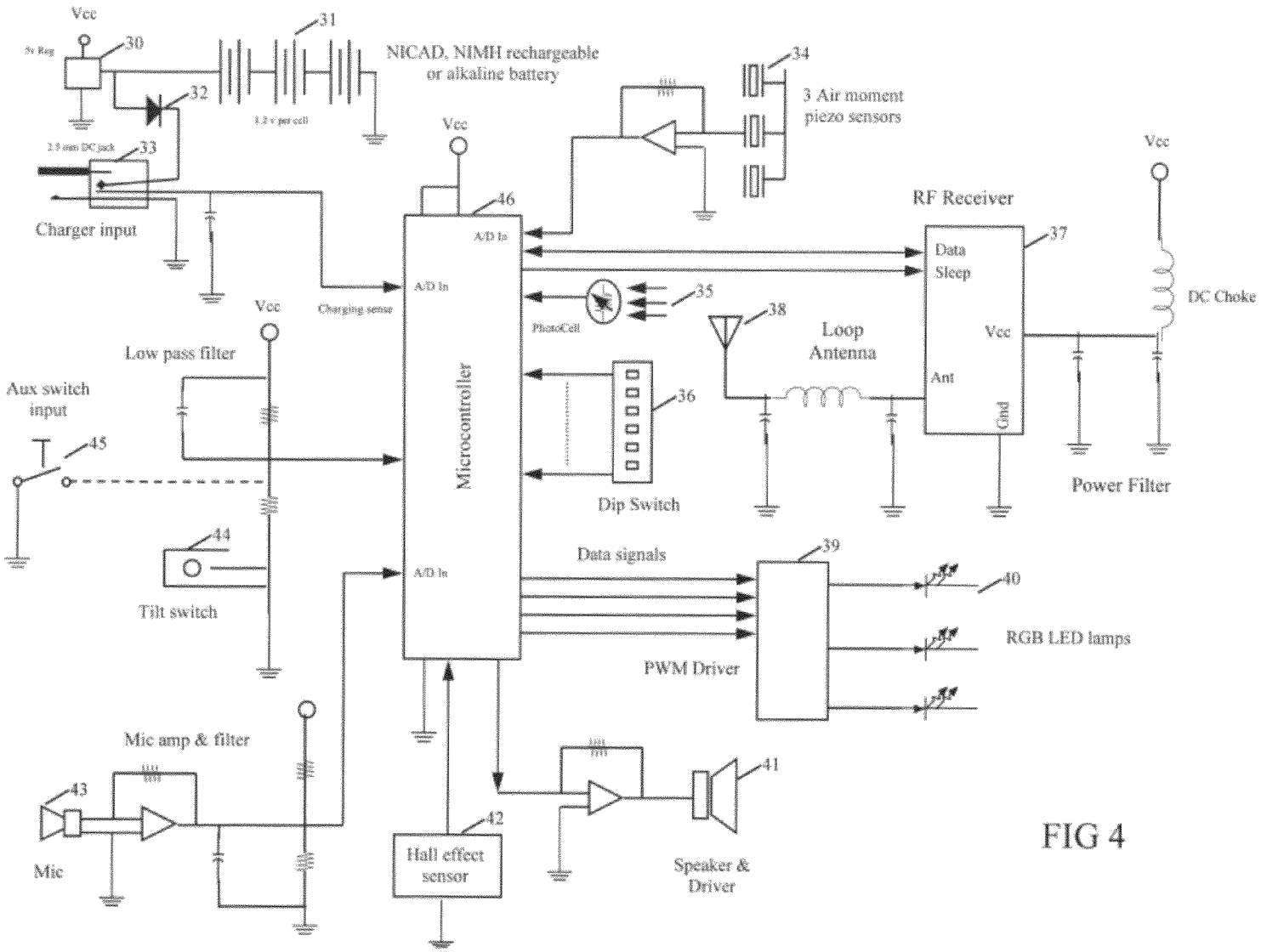
FIG. 4 shows a circuit diagram for a simulated electronic flame apparatus according to one embodiment of the disclosure.

Referring now to FIG. 4, a circuit diagram for the remotely-controlled simulated electronic flame apparatus is shown. In one illustrative embodiment, a voltage regulator 30 converts approximately five 1.2 volt battery cells to the operating voltage of 5 volts dc. The battery cells 31 may be alkaline, nickel metal hydride, lithium ion, lithium ion polymer, nickel cadmium and the like. Battery cells 31 are mounted directly in lamp 50. To prevent the backflow of current, a reverse blocking diode 32 is incorporated into the circuit after voltage regulator 30. A DC Jack connector is provided to connect the charging base 81 to lamp 50.

Three air movement piezo sensors 34 are mounted externally to lamp 50 and provide air movement direction and velocity in three axes. A photocell 35 varies resistance proportionately to the amount of ambient light. At a threshold low level of ambient light sensed by photocell 35, lamp 50 turns on.

An external set DIP switch 36 sets the tri-state digital address of each individual lamp 50. DIP switch 36 also includes a switch to activate a sleep mode power level, "off condition," for lamp 50. A radio frequency receiver 37 in communication with microcontroller 46 operates within the FCC part 15 guide lines. Receiver 37 converts carrier modulated information into digital data carrying the transmitter key code functions. Receiver 37 utilizes either an internal strip line or dipole antennas 38.

A pulse width modulation driver 39 provides high current switching to supply lamps 50. A plurality of red, green and blue LED lamps 40 connected to driver 39 are independently controlled by microcontroller 46. Data signals are sent from microcontroller 46 to lamps 40 through driver 39. An audio output speaker and driver 41 is mounted to the housing for lamp 50 to provide two-way verbal communication with a remote location. A hall-effect sensor 42 in communication with microprocessor 46 detects magnetic lamps holder base 81 and provides on/off and color change functions.

A microphone 43 is mounted internally in holder base 81 and sends voice and other sound information through microprocessor 46 for two-way communication with a remote location. A tilt switch 44 detects tilt movement for control and alarm functions. An auxiliary input switch 45 in communication with microprocessor 46 provides a means to send messages with RF to a central control station, such as computer 57.

Figure 6:
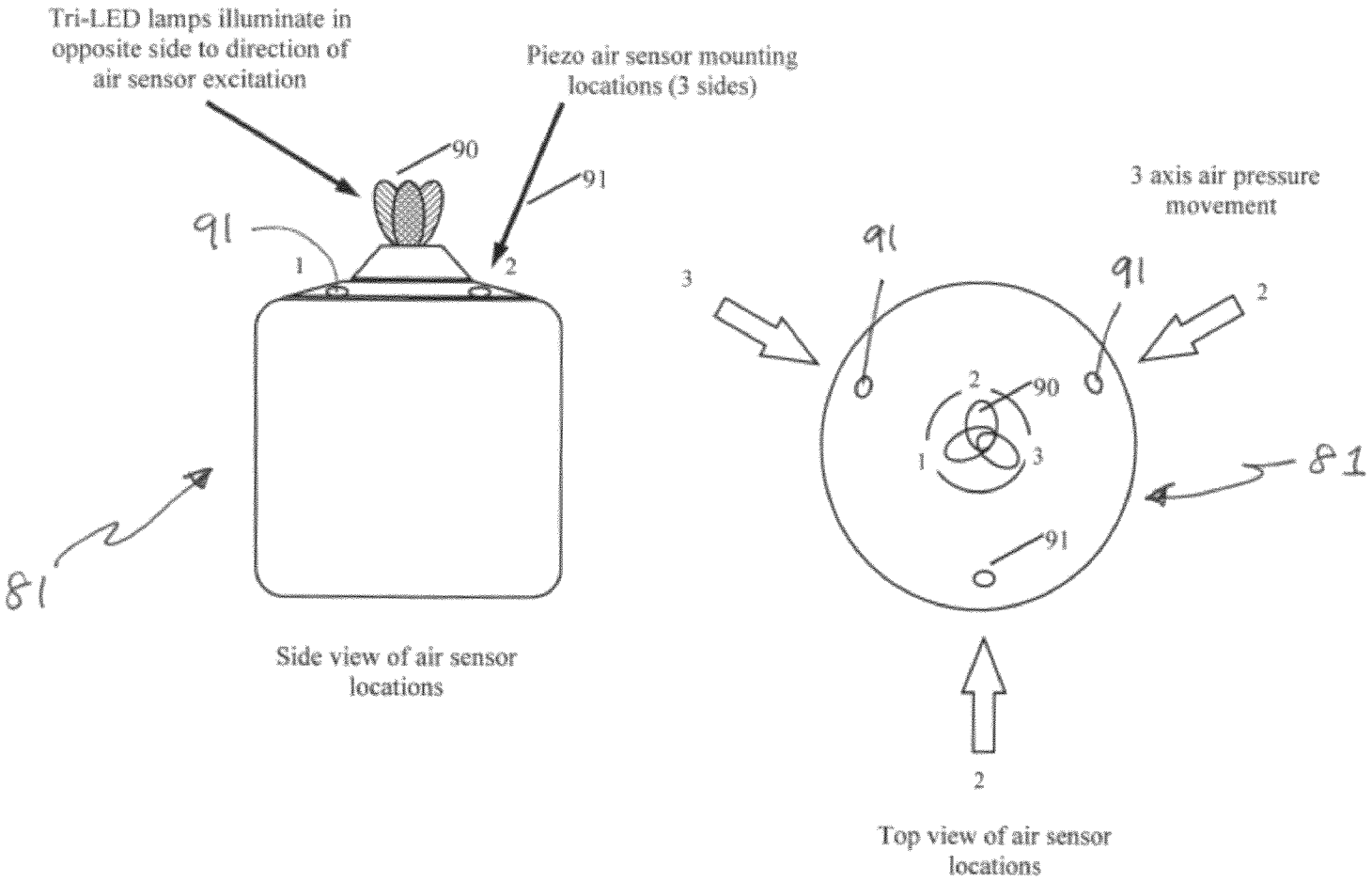
FIG. 6 shows a side elevational view and a top view of an electronic holder base and electronic candle assembly according to one embodiment of the disclosure.

Referring now to FIG. 6, in one aspect of the disclosure an integrated quad LED cluster 90 is shown that uses an internally mounted single or RGB LED lamp 50. In one embodiment, three LED lamps are arranged in a cluster with each lamp bearing an angular offset from perpendicular. In another embodiment, a single LED is mounted substantially within the top center of holder base 81 to impart continuous backlight illumination that mimics a real flame. Each LED is controlled individually in a quasi-random manner to dim and brighten in multiple steps.

To mimic the effects imparted to real flames caused by environmental conditions such as moving air masses, a series of piezo sensors 34 distributed about the interior of holder base 81 receive and sense air pressure through apertures 91 arranged about a top surface of holder base 81 in substantial alignment with the internally-located sensors 34. Based on readings received by the sensors, microprocessor 46 sends control signals to the individual LED lamps to control brightness. LED lamps located opposite the direction of an air sensor excitation event, is controlled to brighten so as to impart the effect of a breeze disturbing the simulated flame. The sensitivity to air movement is selectable via hardware or software commands as is well understood in the art. In the embodiment as shown, three equally spaced apertures 91 are provided about holder base 81. The spacing and numbering of the apertures and associates sensors 34 can be adjusted as desired. A minimum of two aperture/sensor combinations should be used to provide variability to LED lamp brightness control.

Figure 7:
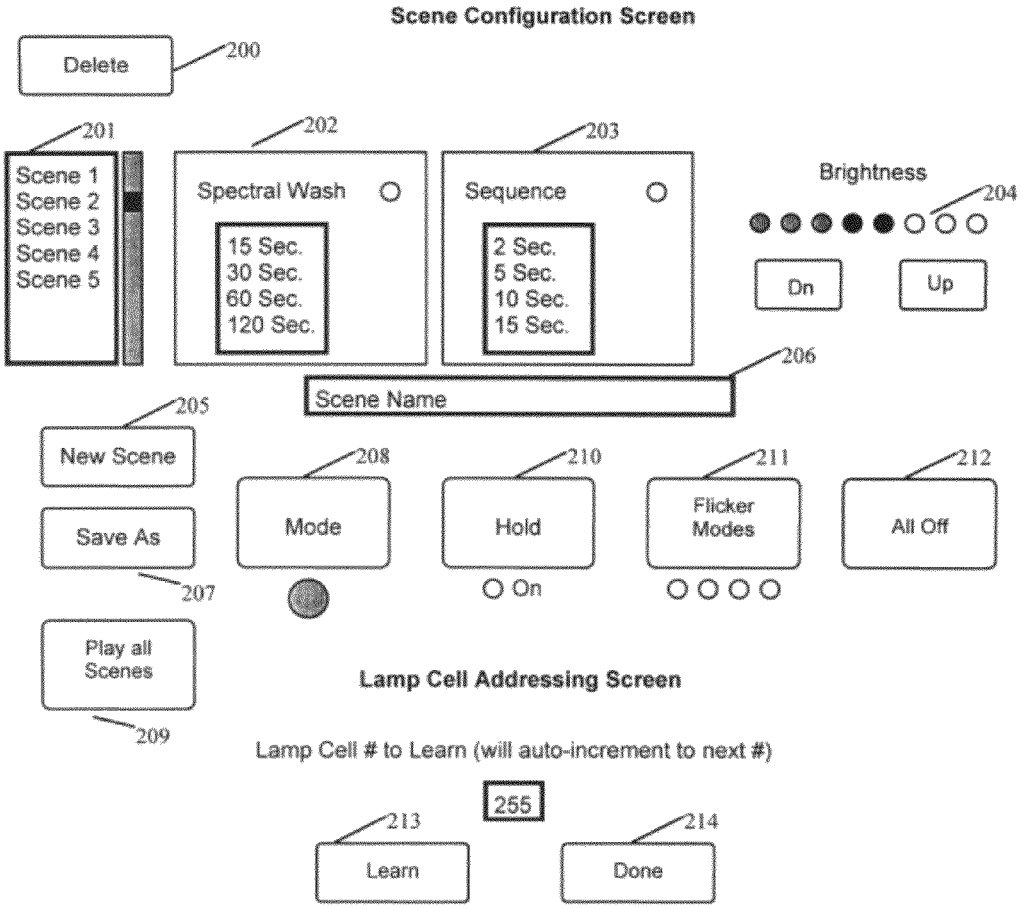
FIG. 7 shows a scene configuration screen according to another embodiment of the disclosure.

Referring now to FIG. 7, a scene configuration screen according to another aspect of the disclosure is shown. This optional onscreen computer control and Internet-based portal system may be incorporated into the system as an optional control system to handheld transmitters. Alternatively, both the computer control and handheld transmitters may be used simultaneously. The screen can be used as a standalone system locally and/or as a web based interface from a remote location.

A delete function 200 enables a user to delete a scene previously created from a selectable scene list 201. When a saved scene in list 201 is highlighted, all the parameters of the profile are shown in the screen display. Spectral wash 202 enables the user to select predetermined total length of time settings of a color wash effect before restarting a loop. Sequence selector 203 enables a user to select the amount of time before each lamp in a sequence group changes to the next color designation in a sequence. Brightness selector 204 enables a user to select the brightness level of all lamps by using the down and up controls as shown. It should be noted that real time brightness is configured to work in any mode. New scene selector 205 enables a user to activate a scene creation mode and label function. Scenes are stored profiles of different predetermined actions saved for later recall. A scene name display 206 displays the secondary name of a selected scene for ease of reference and recall.

Once a scene profile has been configured, a "save as" selector 207 can be implemented to save the scene profile and name to memory. A mode selector 208 enables a user to scroll through preconfigured profiles. A "play all scenes" selector 209 enables a user to recall and play all stored scene profiles in sequence and override any current mode. A hold selector 210 enables a user to stop or freeze a currently running scene profile until a new command is entered. A flicker mode selector 211 enables a user to commence the flickering effect to simulate natural candle flame performance. A default flicker setting overrides any current mode. An "all off" selector 212 enables a user to turn all operating lamps 50 off and override any current mode.

A learn selector 213 is provided to enable a user to activate the system's internal memory of a selected lamp 50 to store the lamp's address. This selector starts the learn mode process and automatically selects the starting address and auto-increments the lamp's number as learned. Optionally, a window is provided in which the current profile's number is displayed (as shown in FIG. 7). The system auto-increments from the displayed number to the next number. To deactivate this function and exit learn mode, a done selector 214 is provided.

Figure 8:
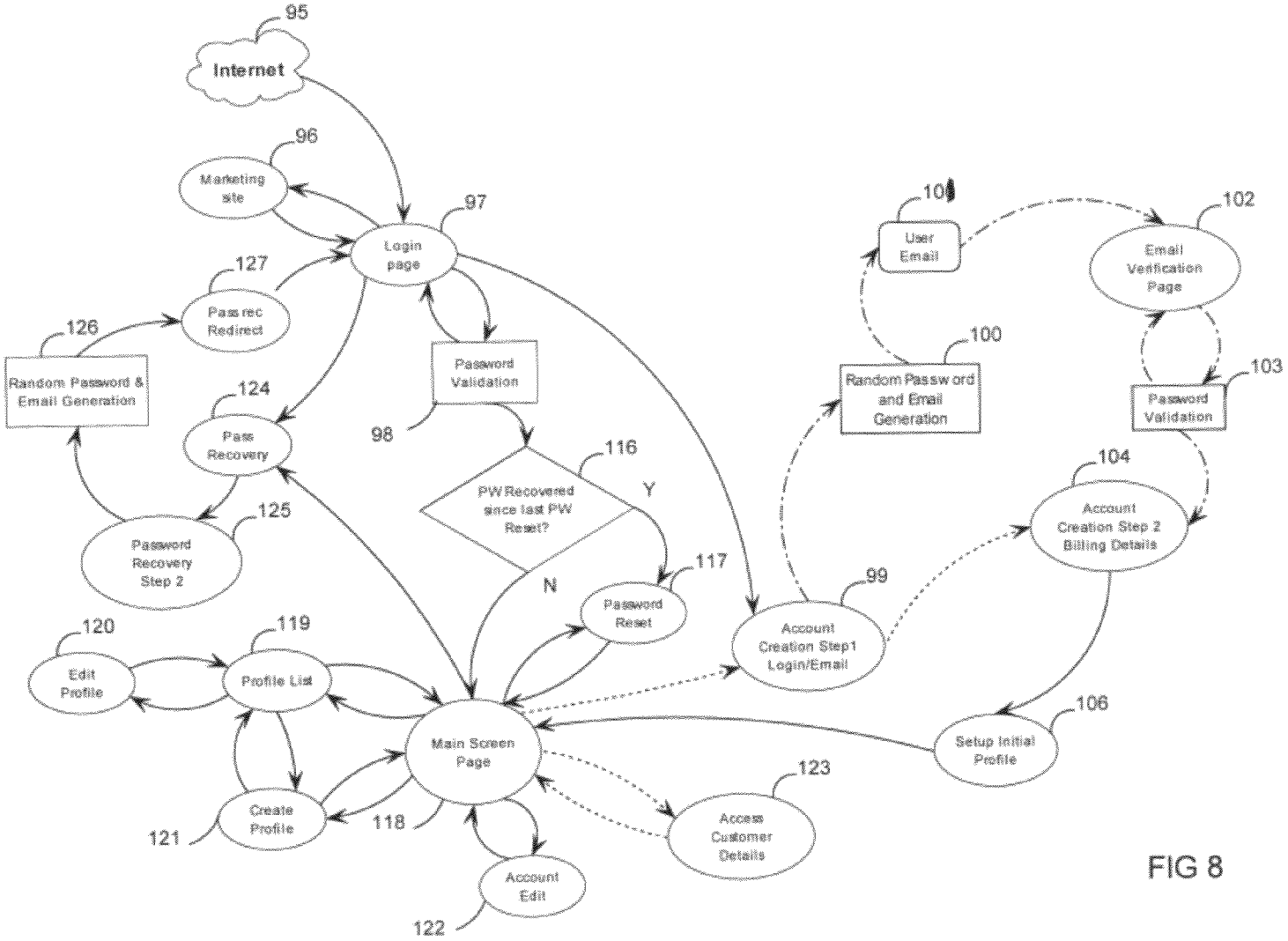
FIG. 8 shows a system flow chart for Internet accessed system portal according to one embodiment of the disclosure.

Referring now to FIG. 8, a system flow chart for remotely accessing and operating the electronic flame apparatus is shown. A user accesses the portal site via an HTTP protocol over TCP/IP networking from the Global Internet at step 95. Access to a market site 96 having the main portal marketing pages is made possible through a login page 97. A user enters a user ID and password for an existing account and the portal validates the user ID and password against encrypted records in the database at step 98.

If the user has no previously established account, an account can be established by entering a user ID with an email address, or other form of identification to be associated with the account at step 99. The portal then creates a randomized password and generates an SMTP-compliant email at step 100 that contains the password for the user, along with a unique URL, which are sent to the user at step 101. The user uses the URL to return to the portal. The user then enters the user ID and password to confirm the email address, which is verified at the email verification page at step 102. Next, the portal verifies the user ID and password combination against encrypted data within the database at step 103. To complete the account creation, the user enters his/her name, mailing address, billing address, and payment details, etc., for storage in the database at step 104.

Once an account is established, the user can create a lamp configuration profile, which is stored in the database at step 106. The portal next determines whether a password recovery has been performed since the last time a manual password reset has occurred. If so, a manual reset if forced at step 116. The user may enter a new password at step 117. The user is now brought to the main screen page at step 118, which is the main control interface screen page for lamp sequence configuration and function controls. The portal lists the stored profiles for the currently logged in user at step 119. The user may edit a stored profile at step 120. The user may also create a new stored profile at step 121. The user may edit stored account information such as mailing address, billing address, payment details, etc., at step 122. Dealers, customer service personnel, and any other authorized personnel may access customer details for other accounts at step 123.

In the event a user cannot recall the user password for an account, the user may enter a user ID or email address to begin the password recovery process at step 124. At step 125, the user enters the answer to a question stored in the user's account as a user verification means. The portal creates a randomized password and generates an SMTP-compliant email containing the password to the user at step 126. The portal next redirects the browser back to the portal login screen for further activity by the user at step 127.

Figure 9:
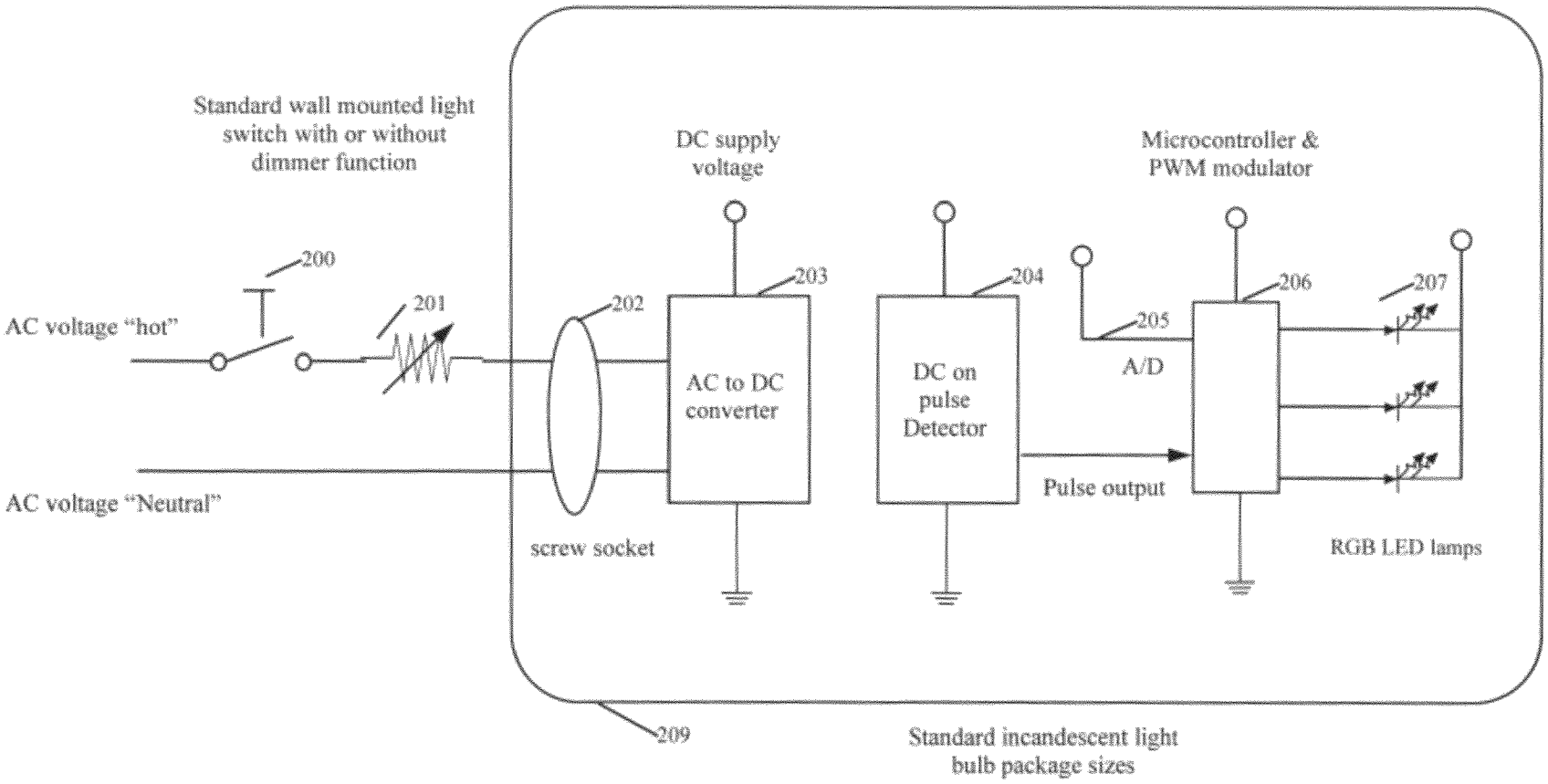
FIG. 9 shows a circuit diagram for a simulated electronic flame apparatus according to one embodiment of the disclosure.

Referring now to FIG. 9, a circuit diagram for a switch-controlled incandescent light assembly is shown. A standard wall and box mounted AC light control switch with on/off function 200 is connected to a standard wall and box mounted AC light control switch 201 with added resistive, or Pulse Width modulated dimmer function. Switch 201 is connected to a standard incandescent light bulb screw socket connector 202. Screw socket 202 is connected to an AC to DC voltage converter 203 for supply and variable voltage outputs. A DC pulse detector circuit 204 outputs a signal when power is first applied or being removed. A DC level input signal 205 is received and sent to a microcontroller and Pulse Width Modulator circuit 206 to change RGB brightness levels in accordance with color output lookup tables stored in microcontroller 206. RGB LED lamps 207 are controlled independently by microcontroller 206 and mounted to output diffused light similar to an incandescent bulb with the addition of multiple colors. All the circuitry is mounted into a standard incandescent type assembly 209 of any size, standard or nonstandard.

Figure 10:
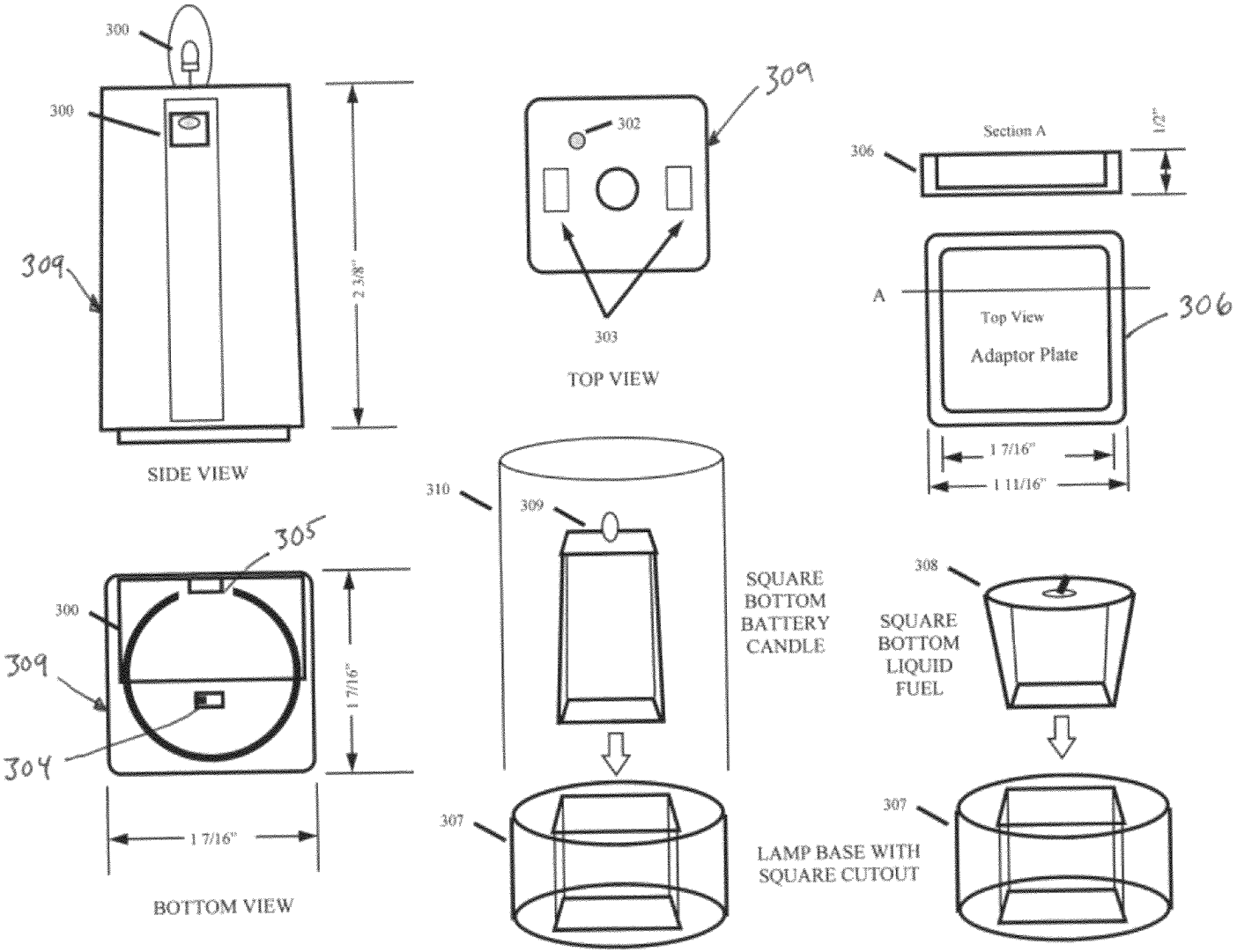
FIG. 10 shows multiple views of conventional liquid fuel and substituted electronic candle lighting according to one embodiment of the disclosure.

Referring now to FIG. 10, in one aspect of the disclosure, an electronic flame apparatus fitted to conventional candle-based lighting systems is shown. Electronic candle 309 has an IR receiver phototransistor 300 mounted in a flame top, or IR receivers mounted on the surface of the candle housing (both configurations shown). A low battery indicator light 302 illuminates to indicate less than ⅓ battery charge remaining. It should be understood that other battery charge levels may be used to trigger activation of indicator light 302. Clear windows 303, preferably two, are positioned on the top of the candle housing 309 at different locations to maximize and allow for omni-directional reception from an IR control transmitter.

A mechanical on/off switch 304 is mounted on the bottom of candle housing 309 to allow for individual control of the electronic candle without IR remote control transmitter control. A battery access door 305 is provided on the bottom of housing 309 to allow access to the battery compartment to dispose or install disposable and/or rechargeable batteries. An optional adaptor plate 306 fits on the bottom of candle housing 309 to enlarge the size for different sized square or other holder inset shape configurations.

A standardized lamp base 307 having a square cutout and used with square bottom liquid fuel candles 308 may be used to receive electronic candle housing 309, which can be dimensioned to fit within the square cutout. A standardized cylindrical globe 310 may be positioned on lamp base 307 to obscure the light source with frosted or colored finishes to enhance the simulated flame effect.

Figure 11:
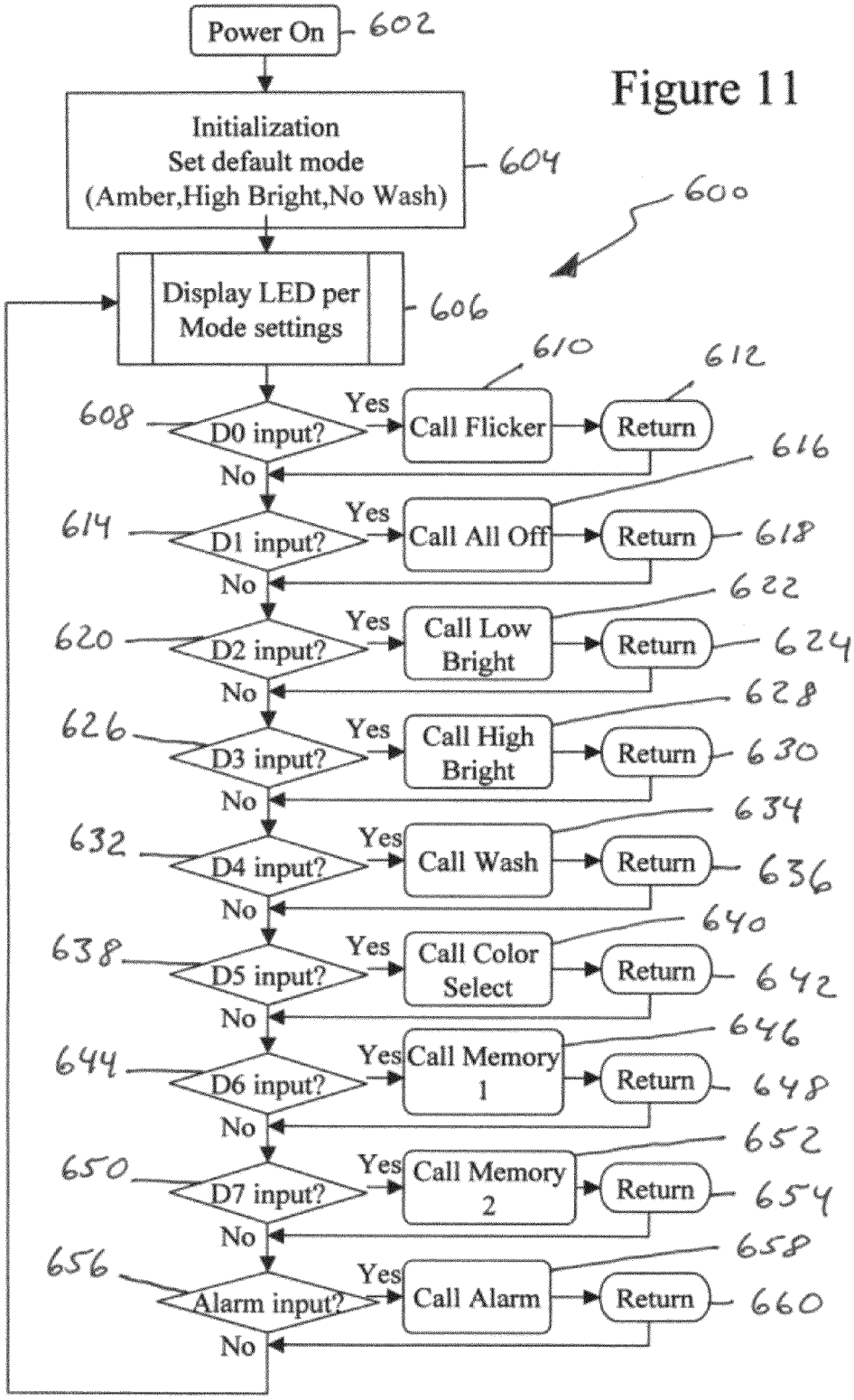
FIG. 11 is an electronic candle profile setting block diagram according to one embodiment of the disclosure.

Referring now to FIG. 11, an electronic candle profile setting routine is shown generally as 600. The routine can be operated from a computer touch screen or via computer keys. To begin, the system user initiates power on at step 602. The system is then initialized and set to default mode for features such as coloring, brightness and wash at step 604. The screen then switches to a display LED for mode settings to enable the user to input selections at step 606. If the user selects a D0 input at step 608, a call flicker setting is initiated at step 610, and the system returns for further selections at step 612. If a D0 input is not selected, or the system returns for further selections, the user can select a D1 input at step 614, which initiates a call all off setting at step 616. The system then returns for further selections at step 618.

If a D1 input is not selected, or the system returns for further selections, the user can select a D2 input at step 620, which initiates a call low bright setting at step 622. The system then returns for further selections at step 624. If a D2 input is not selected, or the system returns for further selections, the user can select a D3 input at step 626, which initiates a call high bright setting at step 628. The system then returns for further selections at step 630.

If a D3 input is not selected, or the system returns for further selections, the user can select a D4 input at step 632, which initiates a call wash setting at step 634. The system then returns for further selections at step 636. If a D4 input is not selected, or the system returns for further selections, the user can select a D5 input at step 638, which initiates a call color select setting at step 640. The system then returns for further selections. If a D5 input is not selected, or the system returns for further selections, the user can select a D6 input at step 644, which initiates a call memory 1 setting at step 646. The call memory 1 setting can coordinate one or more pre-selected settings for one or more features of the system. Following initiation of call memory 1, the system returns for further selections at step 648.

If a D6 input is not selected, or the system returns for further selections, the user can select a D7 input at step 650, which initiates a call memory 2 setting at step 652. The call memory 2 setting coordinates one or more pre-selected settings for one or more features of the system. Call memory 2 settings can include one or more settings similar to those set in call memory 1. It should be understood that the system can incorporate a plurality of call memory settings beyond the two shown for illustrative purposes. Following initiation of call memory 2, the system returns for further selections at step 654. If a D7 input is not selected, or the system returns for further selections, the user can select an alarm input at step 656, which initiates a call alarm at step 658. The system then returns for further selections at step 660. Once all input options have been selected the system returns to the LED display shown at step 606.

Referring now to FIG. 12, an electronic candle color setting routine is shown generally as 662. A display LED for color mode settings is initiated at step 664 on a computer touch screen or via computer keyboard. The system then loads red/green/blue (R/G/B) values from a predefined color table at step 666. The user can select brightness level from a group of predefined levels, e.g., 1, ¾, ½ or ¼ at the same step. It should be understood that the brightness level definitions can be programmed to suit any particular needs and that the example given is by way of illustration and not limitation.

Once the color values have been loaded, the system starts an 8-bit timer for a 488 Hz refresh signal at step 668. The system then determines if the timer value is greater than the red LED value at step 670. If yes, the red LED is turned off at step 672 and the system returns to evaluate the green setting. If the timer value is less than the red LED value, the red LED is turned on at step 674. The system then proceeds to evaluate the green LED value at step 676. If the timer value is greater than the green LED value, the green LED is turned off at step 678 and the system returns to evaluate the blue setting. If the timer value is less than the green LED value, the green LED is turned on at step 680. The system then proceeds to evaluate the blue setting at step 682. If the timer value is greater than the blue LED setting, the blue LED is turned off at step 684 and the system returns to determine if there is timer overflow at step 688. If the timer value is less than the blue LED value, the blue LED is turned on at step 686. The system then determines if there is timer overflow at step 688. If yes, the system continues at step 690. If no, the system returns to step 688.

Referring now to FIG. 13, an electronic candle brightness and flicker setting subroutine, shown generally as 692, enables a user to select brightness and flicker settings for the electronic flame apparatus. A subroutine flicker setting is initiated at step 694. A start 16-bit timer for continuous free running can next be initiated by the user at step 696. The user is then prompted to read and add high low bytes to compile an 8-bit random number at step 698. The subroutine then assigns random number bits—1,0—as brightness settings to control four brightness levels for the flicker function at step 700. It should be understood that the number of brightness levels can be increased or decreased as desired.

The subroutine next assigns random number bits—3,2,1, 0,7—to function as flicker duration counters at step 702. Again, the duration can be adjusted upwardly or downwardly as desired. The subroutine next determines if the brightness level is equal to the lowest programmed setting at step 704. If yes, the subroutine continues to step 708, described below. If no, the display LED mode settings is initiated at step 706. The subroutine then checks for D)-D7 inputs and for an alarm input at step 710. If the subroutine detects the presence of D1, D4, D5, D6, D7, or an alarm input at step 712, the subroutine returns to the main program at step 714. If the inputs are not detected, the subroutine returns to step 698.

At step 708, the subroutine determines whether the duration is greater than 12 counts. If no, the subroutine returns to the loop beginning at step 706. If yes, the subroutine sets the duration counter to 12 (98.3 ms) at step 716. The subroutine then returns to the loop at step 706. It should be understood that the duration counter can be adjusted to increase or decrease the duration as desired.

Figure 14:
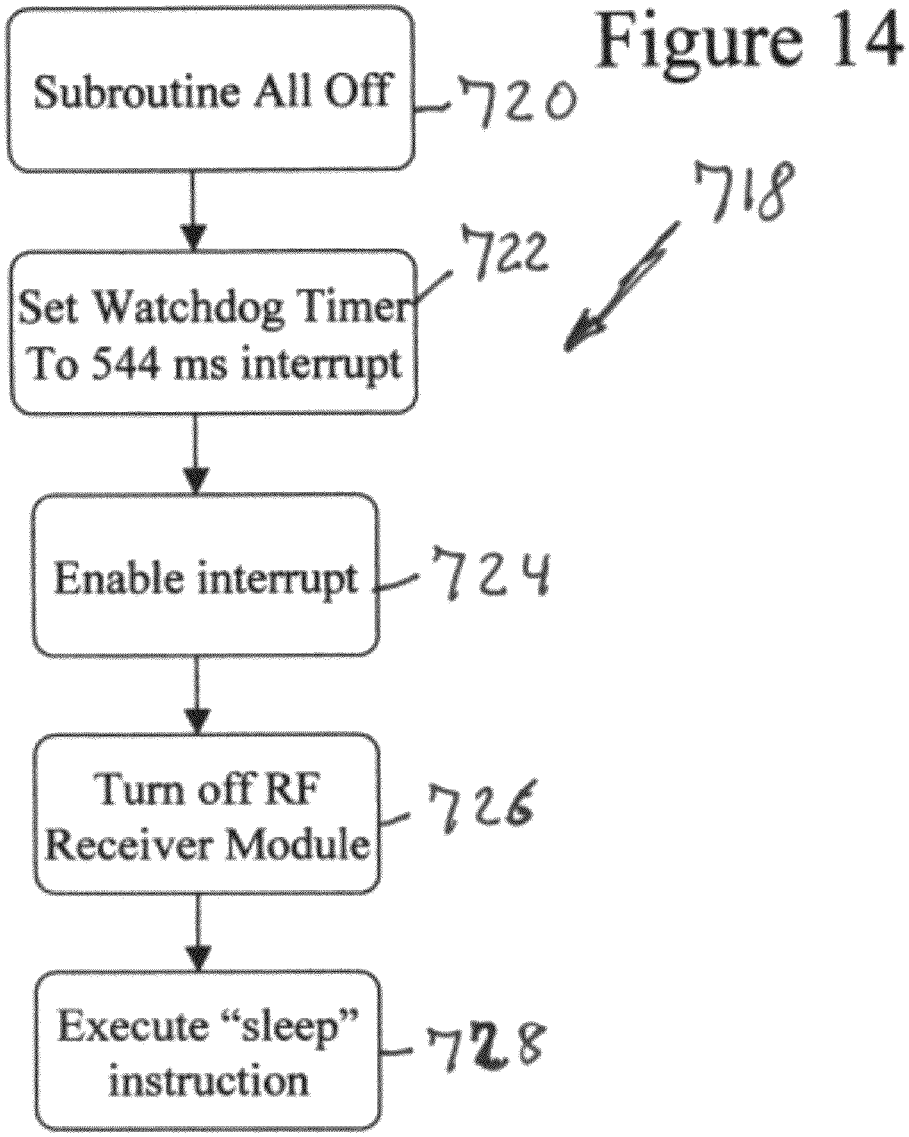
FIG. 14 is an electronic candle shut down sequence block diagram according to one embodiment of the disclosure.

Referring now to FIG. 14, a shut down routine is shown generally as 718. The routine begins with all subroutines being turned off at step 720. The watchdog timer is set to a 544 millisecond interrupt segment at step 722. It should be understood that the interrupt segment can be adjusted increased or decreased as desired. Interrupt mode is enabled at step 724. The RF receiver module is turned off at step 726. And an execute "sleep" instruction is initiated at step 728.

Figure 15:
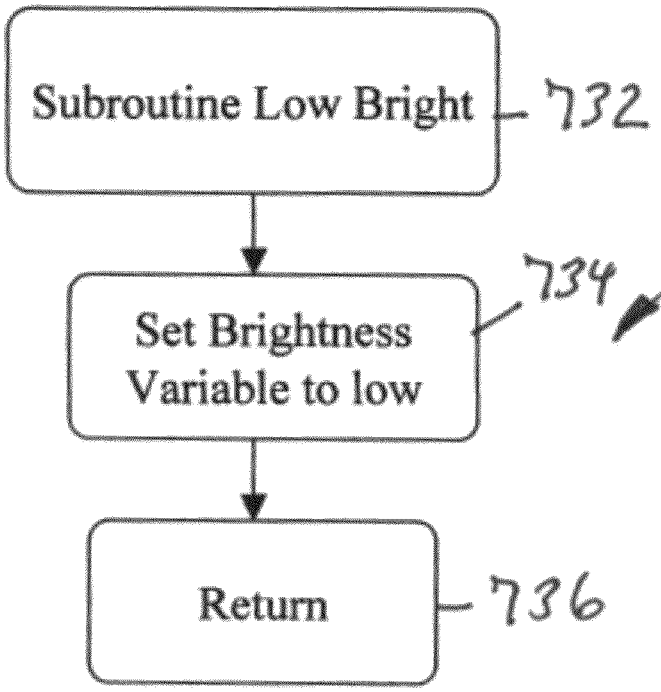
FIG. 15 is an electronic candle low brightness subroutine block diagram according to another embodiment of the disclosure.

Referring now to FIG. 15, a low brightness subroutine is shown generally as 730. The low brightness subroutine is initiated at step 732. The brightness variable is set to low at step 734. The subroutine returns to the main program at step 736.

Figure 16:
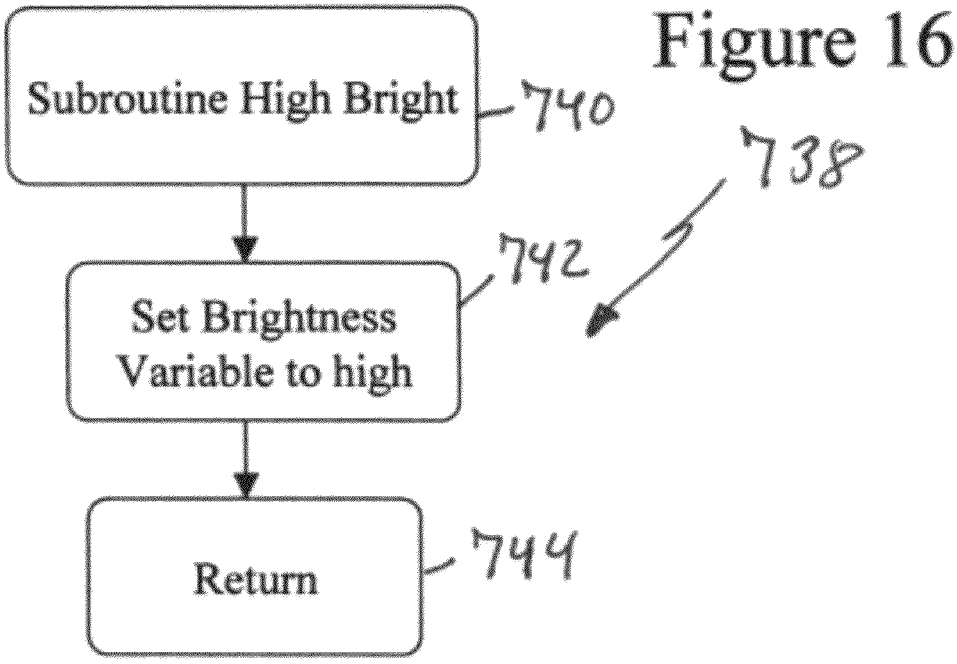
FIG. 16 is an electronic candle high brightness subroutine block diagram according to a further embodiment of the disclosure.

Referring now to FIG. 16, a high brightness subroutine is shown generally as 738. The high brightness subroutine is initiated at step 740. The brightness variable is set to high at step 742. The subroutine returns to the main program at step 744.

Figure 17:
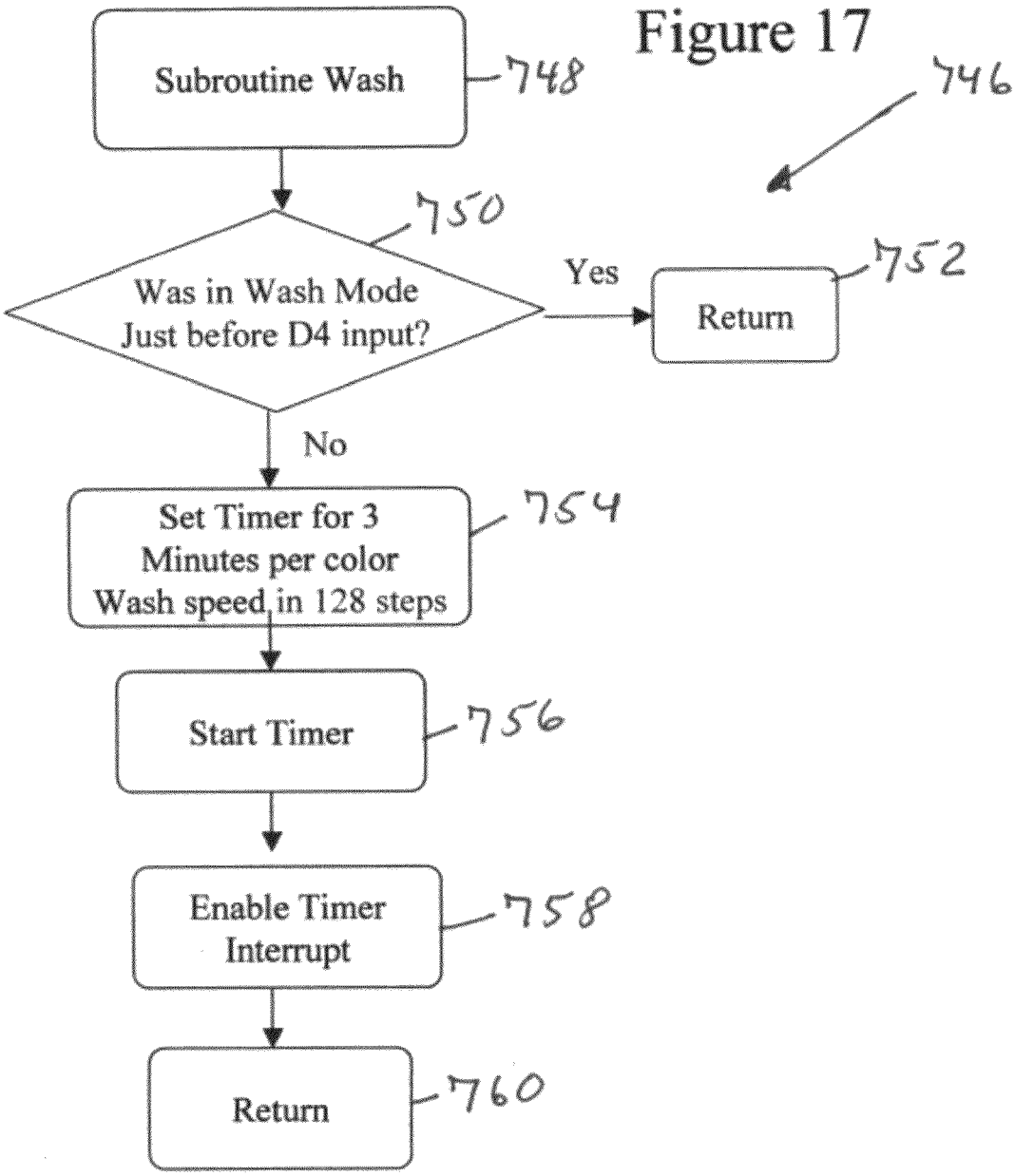
FIG. 17 is an electronic candle color wash subroutine block diagram according to an alternate embodiment of the disclosure.

Referring now to FIG. 17, a wash subroutine is shown generally as 746. The wash subroutine is initiated at step 748. The subroutine determines whether the settings were in wash mode just prior to the D4 input. If yes, the subroutine returns to the main program at step 752. If no, the timer is set for 3 minutes per color at a wash speed in 128 steps at step 754. It should be understood that the timer setting and wash speed can be increased or decreased individually as desired. The subroutine next enables the timer interrupt feature at step 758. The subroutine next returns to the main program at step 760.

Figure 18:
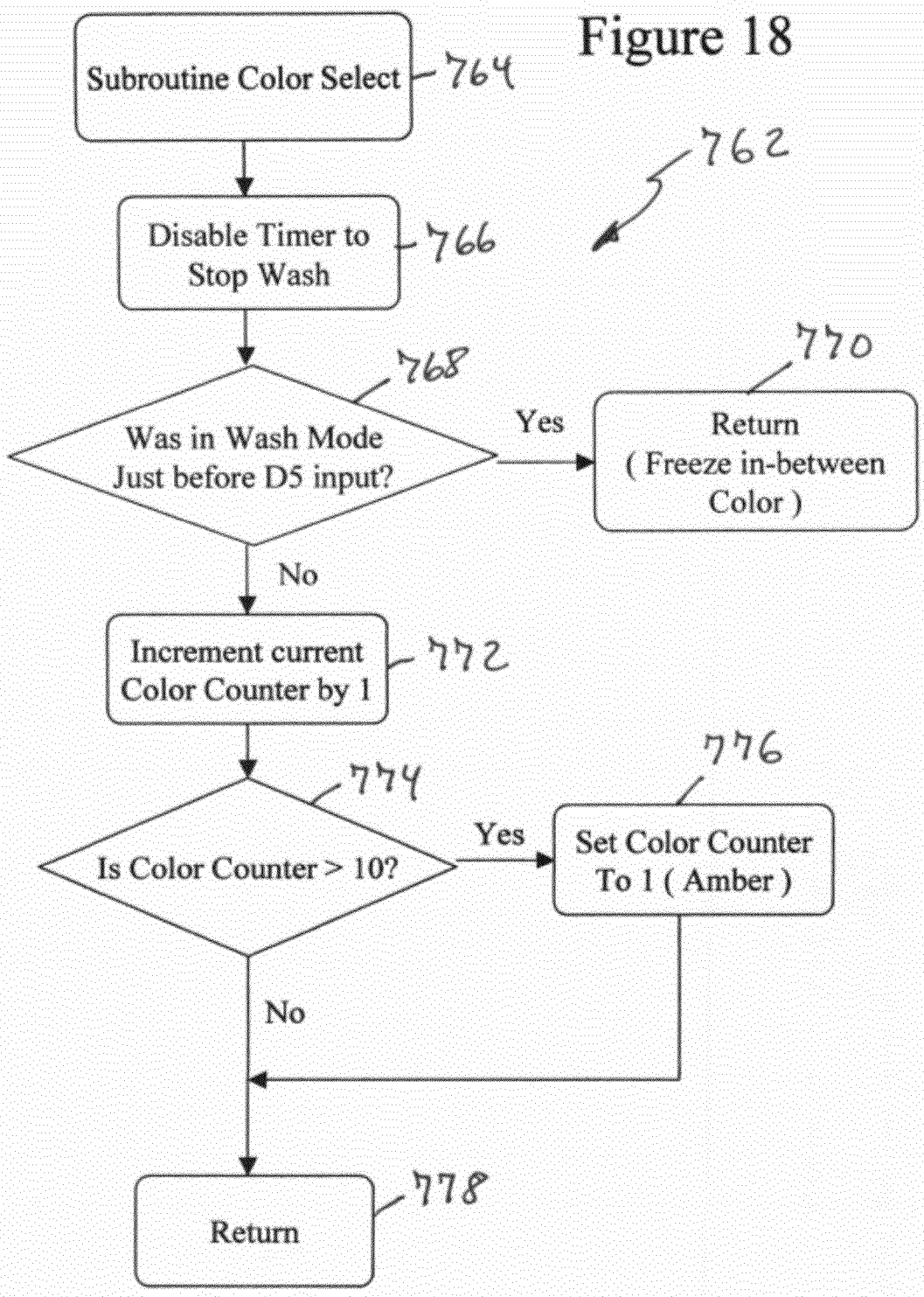
FIG. 18 is an electronic candle color select subroutine block diagram according to an embodiment of the disclosure.

Referring now to FIG. 18, a color select subroutine is shown generally as 762. The color select subroutine is initiated at step 764. The timer is disabled to stop the wash function at step 766. Next, the subroutine determines if the settings were in wash mode just prior to the D5 input. If yes, the subroutine returns to the main program at step 770 with a temporary freeze in between color. If no, a current color counter is incrementally increased by 1 at step 772. It should be understood that the increase unit can be greater than 1. Following this step, the subroutine determines if the color counter is greater than 10. If yes, the color counter is set to 1 (amber) at step 776. After setting the color counter, the subroutine returns to the main program at step 778. If no, the subroutine returns to the main program at step 778.

Figure 19:
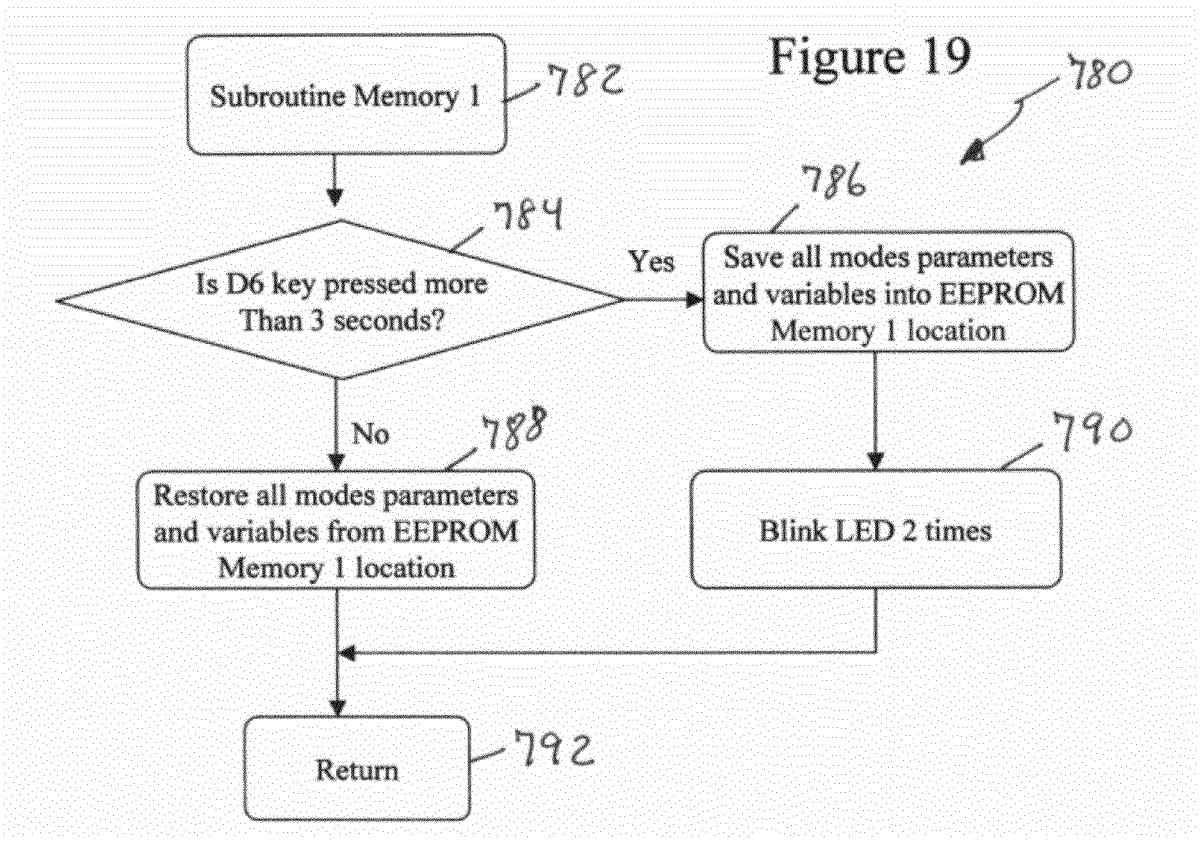
FIG. 19 is an electronic candle setting memory subroutine block diagram according to an embodiment of the disclosure.

Referring now to FIG. 19, a subroutine for memory 1 is shown generally as 780. Subroutine memory 1 is initiated at step 782. The subroutine determines if the D6 key has been pressed more than 3 seconds. If yes, the all modes parameters and variables are saved into the EEPROM memory 1 location at step 786. The user is informed about the memory save when the LED blinks two times at step 790. The subroutine then returns to the main program at step 792. If the subroutine does not detect the D6 key as being depressed more than 3 seconds, all modes parameters and variables from EEPROM are restored from the memory 1 location at step 788. The subroutine returns to the main program at step 792.

Figure 20:
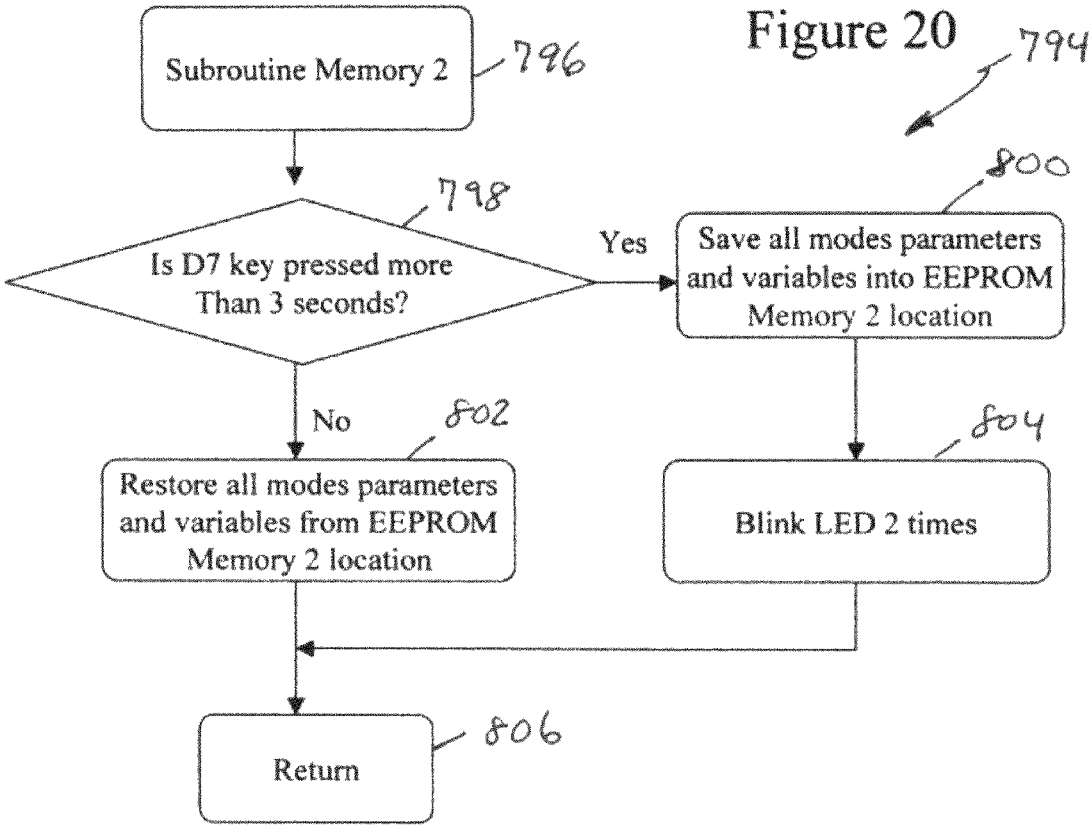
FIG. 20 is an electronic candle alternate setting memory subroutine block diagram according to an embodiment of the disclosure.

Referring now to FIG. 20, a subroutine for memory 2 is shown generally as 794. Subroutine memory 2 is initiated at step 796. The subroutine determines if the D7 key has been pressed more than 3 seconds at step 798. If yes, the all modes parameters and variables are saved into the EEPROM memory 2 location at step 800. The user is informed about the memory save when the LED blinks two times at step 804. The subroutine then returns to the main program at step 806. If the subroutine does not detect the D7 key as being depressed more than 3 seconds, all modes parameters and variables from EEPROM are restored from the memory 2 location at step 802. The subroutine returns to the main program at step 806.

Figure 20A:
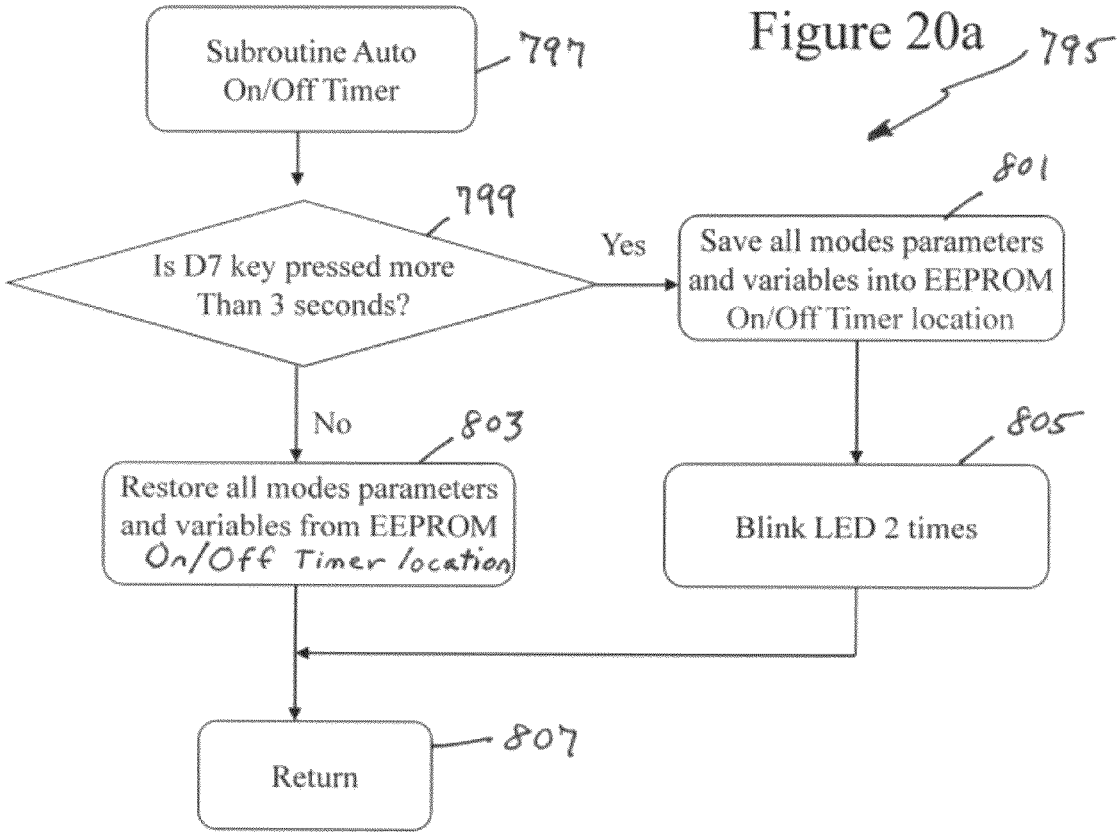

Referring now to FIG. 20*a*, an automatic on/off timer subroutine is shown generally as 795. The on/off timer subroutine is initiated at step 797. The subroutine determines if the D7 key has been pressed more than 3 seconds at step 799. If yes, the all modes parameters and variables are saved into the EEPROM on/off timer location at step 801. The user is informed about the on/off timer save when the LED blinks two times at step 805. The subroutine then returns to the main program at step 807. If the subroutine does not detect the D7 key as being depressed more than 3 seconds, all modes parameters and variables from EEPROM are restored from the on/off timer location at step 803. The subroutine returns to the main program at step 807.

Referring now to FIG. 21, an interrupt service subroutine is shown generally as 808. The interrupt service routine is initiated at step 810. The routine determines if the wash timer is interrupted (timer interrupt flag=1) at step 812. If yes, the routine goes to the timer interrupt at step 814. If no, the routine determines if the watchdog timer is interrupted (watchdog interrupt flag=1) at step 816. If yes, the routine goes to watchdog interrupt at step 818. If no, the routine returns from the interrupt at step 820.

Referring now to FIG. 22, a timer interrupt routine is shown generally as 822. The timer interrupt routine is initiated at step 824. The routine calculates the difference between the current and next color R/G/B LED values at step 826. The routine next determines if the time has lapsed 1.4 seconds (3 minutes divided by 128 steps) at step 828. If yes, the routine increases or decreases the R/G/B value one step to the next color at step 830. The routine then returns from the interrupt at step 832. If no, the routine returns from interrupt at step 834.

Referring now to FIG. 23, a watchdog interrupt subroutine is shown generally as 836. The watchdog interrupt subroutine is initiated at step 838. The subroutine activates the microprocessor and turns on the RF receiver for 262.144 ms in step 840. The subroutine next determines if valid RF keys have been received (VT signal on RF receiver=1) in step 842. If yes, the subroutine determines if D0, D4, D5, D6, or D7 inputs are present in step 844. If any of the inputs are present, the subroutine activates a wakeup function and go to power on at step 846. If a valid RF key has not been received at step 842, the subroutine sets the watchdog timer to 544 ms interrupt at step 848. The subroutine next enables the interrupt function at step 850. The RF receiver module is next turned off at step 852. Next, the subroutine executes a "sleep" instruction at step 854.

Referring now to FIG. 24, an alarm subroutine is shown generally as 856. The alarm subroutine is initiated at step 858. The subroutine determines if the system is armed (arm flag=1) in step 860. If the system is found not to be armed, the subroutine determines if a magnet is present at step 862. If the magnet is present, the subroutine arms the system (arm flag=1) at step 864. The subroutine returns to the main program at step 868. If the magnet is not present, the subroutine disarms the system (arm flag=0) at step 866. The subroutine next returns to the main program at step 868.

If the system is found to be armed at step 860, the subroutine determines if the magnet is present at step 870. If yes, the subroutine returns to the main program at step 868. If no, the subroutine triggers a silent alarm (red LED blinks) at step 872. The subroutine next determines if the magnet present at step 874. If yes, the subroutine stops the red LED from blinking at step 878, and returns to the main program at step 880. If the magnet is not found present at step 874, the subroutine determines if 10 minutes has lapsed at step 876. If yes, the subroutine stops the red LED from blinking at step 878, and returns to the main program at step 880. If 10 minutes are not determined to have passed at step 876, the subroutine determines if the D3 key has been received at step 882. If yes, the subroutine stops the red LED from blinking at step 878, and returns to the main program at step 880. If the D3 key has not been received at step 882, the subroutine returns to step 872.

Referring now to FIG. 25, a graph is shown depicting a flicker brightness algorithm. The algorithm is constructed so that flicker brightness never reaches 0% brightness. An artificial minimum of 25% brightness is set to rise incrementally or linearly in one direction to 100% brightness. Once 100% brightness is achieved, flicker brightness drops incrementally or linearly in one direction to a minimum established value such as 25%. The up and down brightness cycle is cyclically repeated whereby each time fragment (T1, T2, etc.), or time duration is a random number generated in steps of 8.192 milliseconds. The time fragments may be generated in any variable or structured steps as desired, all within the scope and spirit of the disclosure and appended claims.

Referring now to FIG. 26, a combination lamp/data transport router system is shown generally as 400. A network 404 communicates via network communication protocol 403 with main data router 402. Communication protocol 403 may be any protocol including, but not limited to, Mesh, Hopping, WiFi, or any other LAN type network communication protocol. In this embodiment, lamp 50 includes an integrated data transport router that functions as a local wireless data network interface. With an integrated router, lamp 50 provides a portable and moveable low power with high signal strength connection to mobile devices 405. Communication among main data router 402, mobile device 405, and lamps 50, which include integrated antennae 75 is via RF transmission.

Referring now to FIG. 27, in a further embodiment, lamp 50 includes an LED, or fluorescent Black light output 502 to function as backlighting for a screen or board 500 comprised of a light absorbing and light emitting fluorescent plastic material. Screen 500 is used to display and highlight menu 501 or other viewable lighted objects. This lighting configuration promotes enhanced viewing and attraction of the highlighted object under low light conditions.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What we claim as new and desire to secure by United States Letters Patents is:

1. An apparatus for electronically simulating flame comprising:

a holder base;

an electronic illumination source secured to the holder base;

a microprocessor mounted in the holder base to control the brightness, color and activity duration of the electronic illumination source;

a receiver mounted in the holder base to receive control signals and to communicate the signals to the microprocessor for controlling the illumination source;

a transmitter for transmitting control signals to the receiver; and, a combination of ambient condition detectors comprising at least three piezo disc air movement sensors attached to an external surface of the holder base and spaced about the base to sense air movement in three axes and at least one light sensor photocell secured to the holder base to sense ambient light conditions, wherein the sensors detect ambient conditions and send corresponding signals to the microprocessor, and wherein the microprocessor coordinates and processes the signals.

2. The apparatus of claim 1 wherein the electronic illumination source is selected from the group consisting of LED, halogen, incandescent, fluorescent and mixtures thereof.

3. The apparatus of claim 1 wherein the electronic illumination source is a red-green-blue LED lamp.

4. The apparatus of claim 1 wherein the electronic illumination source comprises a plurality of red-green-blue lamps arranged in a cluster on the holder base wherein each lamp is offset at an angle from a longitudinal axis of the holder base.

5. The apparatus of claim 1 wherein the transmitter is integrated into a transmitting device selected from the group consisting of a handheld transceiver, handheld transmitter, computer, and combinations thereof.

6. The apparatus of claim 1 wherein the air movement sensors sense air movement in three axes and send signals to the microprocessor, wherein the microprocessor processes data received in the signals from the air movement sensors and sends commands to alter the properties of the illumination source to mimic the expected effects of any detected air movements on a natural flame.

7. The apparatus of claim 4 wherein the at least three piezo disc air movement sensors detect air movement in three axes, and wherein the air movement sensors send signals to the microprocessor, wherein the microprocessor processes data in the signals and sends commands to alter the brightness of each of the LED lamps to mimic the expected effects of any detected air movements on a natural flame.

8. The apparatus of claim 1 wherein the photocell senses the ambient light conditions and sends a signal to the microprocessor, wherein the microprocessor processes the data in the signal and sends a command to adjust the illumination source brightness relative to ambient light conditions.

9. The apparatus of claim 1 further comprising a dipole antenna attached to the holder base and connected to the microprocessor to receive and transmit wireless signals between the microprocessor and transmitter.

10. The apparatus of claim 1 further comprising a strip line attached internally to the holder base and connected to the microprocessor to receive and transmit wireless signals between the microprocessor and transmitter.

11. The apparatus of claim 1 further comprising a tilt switch attached to the holder base to detect tilting of the holder base for control and alarm functions.

12. The apparatus of claim 1 further comprising a magnetic lamp holder base having at least one magnet for connection to the holder base.

13. The apparatus of claim 12 further comprising a hall-effect sensor attached to the holder base to detect the presence of the magnetic lamp base holder.

14. The apparatus of claim 13 wherein the lamp base holder has a plurality of magnets to control and vary the illumination source brightness and color scheme.

15. The apparatus of claim 1 further comprising a driver connected to the microprocessor and to the illumination source to deliver control commands to the illumination source from the microprocessor.

16. The apparatus of claim 1 further comprising a globe superposed about the illumination source wherein the globe may be frosted or colored to alter the lighting intensity and color scheme.

17. The apparatus of claim 1 further comprising a remotely controlled on/off timer function programmed into the microprocessor for remotely controlling the illumination source.

18. The apparatus of claim 15 wherein the air movement sensors sense air movement in three axes and send signals to the microprocessor, wherein the microprocessor interprets data received from the air movement sensors and sends commands to the driver to alter the properties of the illumination source to mimic the expected effects of any detected air movements on a natural flame.

19. The apparatus of claim 15 wherein the photocell senses the ambient light conditions and sends a signal to the microprocessor, wherein the microprocessor processes data in the signal and sends a command to the driver to adjust the illumination source brightness relative to ambient light conditions.

20. The apparatus of claim 6 wherein the properties of the illumination source altered include brightness, color and flickering effect.

* * * * *